US005331389A

United States Patent [19]

Fukuchi et al.

[11] Patent Number: 5,331,389

[45] Date of Patent: Jul. 19, 1994

[54] IMAGE FORMING APPARATUS WITH SHEET DISCHARGING DEVICE

[75] Inventors: Masakazu Fukuchi; Shizuo Morita; Satoshi Haneda; Hisao Satoh; Tadayoshi Ikeda, all of Hachioji, Japan

[73] Assignee: Konica Corporation, Tokyo, Japan

[21] Appl. No.: 932,361

[22] Filed: Aug. 19, 1992

[30] Foreign Application Priority Data

| | | | |
|---|---|---|---|
| Sep. 19, 1991 | [JP] | Japan | 3-239670 |
| Sep. 27, 1991 | [JP] | Japan | 3-249539 |
| Dec. 11, 1991 | [JP] | Japan | 3-327793 |
| Dec. 13, 1991 | [JP] | Japan | 3-330732 |

[51] Int. Cl.[5] ..... G03G 15/00

[52] U.S. Cl. ..... 355/321; 271/287; 271/291; 271/295; 355/323

[58] Field of Search ..... 355/313, 319, 323, 321, 355/200, 322; 271/278, 287, 288, 290, 291, 292, 295

[56] References Cited

U.S. PATENT DOCUMENTS

| | | | |
|---|---|---|---|
| Re. 31,768 | 12/1984 | Gerbasi | 271/291 |
| 4,141,546 | 2/1979 | Queener | 271/288 |
| 4,146,215 | 3/1979 | Mol | 270/58 |
| 4,295,733 | 10/1981 | Janssen et al. | 355/313 X |
| 4,368,972 | 1/1983 | Naramore | 355/23 X |
| 4,639,126 | 1/1987 | Bushaw et al. | 271/3.1 X |
| 4,681,310 | 7/1987 | Cooper | 270/53 |
| 4,945,390 | 7/1990 | Hasegawa et al. | 355/321 |
| 5,040,019 | 8/1991 | Ito | 355/50 |
| 5,122,836 | 6/1992 | Fujiwara et al. | 355/212 |
| 5,134,443 | 7/1992 | Sumi et al. | 355/200 |
| 5,182,595 | 1/1993 | Fukuchi et al. | 355/200 |
| 5,201,518 | 4/1993 | Isoda | 271/305 |

FOREIGN PATENT DOCUMENTS 130355 8/1983 Japan .

*Primary Examiner*—A. T. Grimley
*Assistant Examiner*—T. A. Dang
*Attorney, Agent, or Firm*—Jordan B. Bierman

[57] ABSTRACT

An image forming apparatus is provided with a rotatable upper cover, one surface of which serves as a first exit tray on which recording sheets are discharged with image sides face downward, the other surface of which serves as a second exit tray on which recording sheets are discharged with image sides face upward. Guide members which are activated in accordance with the rotation of the rotatable upper cover are provided above delivering rollers, thereby the recording sheets delivered by the delivering rollers are selectively discharged with the image sides either face downward to the first exit tray or face upward to the second exit tray.

7 Claims, 20 Drawing Sheets

IMAGE FORMING APPARATUS WITH SHEET DISCHARGING DEVICE

BACKGROUND OF THE INVENTION

The present invention relates to a sheet discharging device of an image forming apparatus which discharges a transfer sheet on which an image has been fixed.

With reference to FIGS. 5, 6(*a*) and 6(*b*), a sheet discharging device of an image forming apparatus will be explained as follows which forms an image by means of electrophotography.

Referring to FIG. 5, a photoreceptor belt 1 is provided around rotating rollers 2 and 3. When the rotating roller 2 is driven in the arrowed direction, the photoreceptor belt 1 is rotated clockwise. A charger 6, an exposure section composed of a laser writing system unit 7 and 4 developing units 8–11 accommodating 4 kinds of color developers, are sequentially disposed between a cleaning unit 13 located on the right side of the apparatus and a transfer unit 12 located on the left side as shown in FIG. 5. When the operation of charging, exposing and developing is repeated 4 times, a color toner image is formed on the photoreceptor belt 1, and then the color image is transferred onto a transfer sheet which has been sent from a sheet cassette 14. After the transfer operation has been completed, the surface of the photoreceptor belt 1 is cleaned by the cleaning unit 13. After that, the next image is formed by the same image forming process as that described before.

A toner image transferred onto a transfer sheet is fixed by a fixing roller 18.

The transfer sheet on which the toner image has been fixed, is discharged face-down onto a tray by a discharging device, the toner image side being located downward, or face-up, the toner image side being located upward.

Face-down discharging is usually applied to sheet discharging devices. The reason is: when each process from image formation to sheet discharge is sequentially carried out, transfer sheets are naturally discharged in the manner of face-down discharge. Face-up discharge is applied to sheet discharging devices when image quality must be checked, or when enlarged or reduced images are formed which must be checked by an operator.

When a transfer sheet is discharged face-down, a guide member 60 is operated so that the transfer sheet on which an image has already been fixed, is guided in the direction of a passage 621, and discharged onto tray 201 on cover 20 by discharging roller 191. When a transfer sheet is discharged face-up, the guide member 60 is operated so that the transfer sheet on which an image has already been fixed, is guided in the direction of a passage 622, and discharged onto a tray 202 on the image forming apparatus by a discharging roller 192.

FIGS. 6(*a*) and 6(*b*) are views showing circumstances of the sheet discharging device in the cases of face-down discharging and face-up discharging.

FIG. 6(*a*) shows circumstances in the case of face-down discharging.

When transfer sheets are discharged face-down, the tray 202 for face-up discharging is not necessary, so that the tray 202 is removed from the image forming apparatus, and the position in which the tray 202 has been disposed is covered with a cover 204. The guide member 60 can be rotated around a rotating shaft 61. When the guide member 60 is set as shown in FIG. 6(*a*), the transfer sheet on which an image has been fixed is guided in the arrowed direction so that it is guided to the passage 621, and discharged face-down onto the tray 201 by the discharge roller 191.

FIG. 6(*b*) is a view showing circumstances in which a transfer sheet is discharged face-up.

In the case of face-up discharging, the cover 24 provided in the upper portion of the image forming apparatus is opened, and the tray 202 is engaged with a stopper 203 so that it can be mounted in a predetermined position. Then, the guide member 60 is rotated around the rotating shaft 61 so that it can be set at the position shown in the drawing. When the aforementioned operations are completed, the transfer sheet on which a toner image has been fixed, is guided to the passage 622 in the arrowed direction, and discharged onto the tray 202 face-up As explained above, it is not simple to change over between face-down discharging and face-up discharging. That is, it is necessary to conduct preparation work accurately. Practically, it is difficult to do the preparation work accurately. As a result, it is necessary to provide a protective cover or a safety device which is expensive.

For example, there is a possibility that the following disadvantages occur:

In the case of face-down discharging, the tray 202 for use in face-up discharging is not necessary, so that the tray 202 is removed. In the case where the cover 204 is not set after the tray 202 has been removed, various strange articles can enter the apparatus through the opening.

In order to prevent the disadvantages, it is necessary to provide a protective cover inside the apparatus. Alternatively, it is necessary to provide a safety device to interlock the cover 204 and the image forming apparatus which works in the following manner: unless the cover 204 is set, the image forming apparatus does nor work.

The following advantages also occur:

When the guide member 60 has been set so that transfer sheets can be discharged face-up, and when an operator has forgotten to open the cover 204, the transfer sheets drop into the apparatus. When the protective cover is provided in this case, the transfer sheets are jammed under the cover 204. When the cover 204 is opened and the operator has forgotten to set the tray 202, the same problems are caused. In order to prevent the aforementioned disadvantages, it is necessary to provide a safety device which works in the following manner: unless the tray 202 is set, the image forming apparatus does not work.

As described above, in the case of conventional face-down and face-up discharging, it is necessary to conduct preparation work as well as to provide a protective cover and safety device, which increases the cost.

Further, the present invention relates to an image forming apparatus which can discharge transfer sheets either face-down or face-up.

In general, transfer sheets on which an image has been transferred, are discharged outside of the apparatus face-up, because transfer sheets discharged face-up are convenient for checking the image quality in the case of continuous copying.

However, in a recording operation in which facsimile images are recorded by a laser type of image forming apparatus, it is not necessary to check the image quality each time a transfer sheet is discharged. Accordingly, it is advantageous to discharge transfer sheets face-down and put them in order.

In order to meet these requirements, an image forming apparatus is provided which can select between face-down and face-up discharging.

However, in the case of an image forming apparatus provided with a sorter which sorts discharged transfer sheets, it is difficult to change the direction of transfer sheets since the structure becomes complicated. Therefore, this type of image forming apparatus has not been realized yet.

According to Japanese Patent Application Open to Public Inspection No. 130355/1983, an image forming apparatus is proposed which can conduct two-sided copying. When images are formed by this apparatus on both sides of a transfer sheet, the transfer sheet is discharged with the first image formation side of the transfer sheet set downward. Therefore, this image forming apparatus can not accomplish the aforementioned object.

Further, the present invention relates to an image forming apparatus provided with a sorting device which collects and sorts transfer sheets onto which an image has been transferred.

According to a conventional electrophotographic image forming apparatus, an image forming operation is performed in the following manner: a document placed on a platen mounted on the upper surface of the image forming apparatus, is scanned by an exposing device; the scanned image is sent to a photoreceptor which is provided in the middle portion of the image forming apparatus, electrically charged and rotated at a constant speed so that the photoreceptor is exposed to the scanning light and a latent image is formed on the surface of the photoreceptor; the latent image is developed by a developing unit provided around the photoreceptor so that a visualized toner image is formed; the toner image is transferred onto a transfer sheet conveyed to the lower portion of the photoreceptor synchronously with image formation; the transfer sheet is conveyed to a fixing unit provided on the side of the photoreceptor so that the transferred image is fixed; the transfer sheet is discharged on a sorter which is provided on the side of the apparatus so that the transfer sheet is sorted in order; and finally the sorted transfer sheets are collected.

When a copy operation is performed by an operator in an electrophotographic image forming apparatus, especially in an electrophotographic copier, the apparatus is operated from the front. However, a sorter which sorts the copied sheets is vertically provided on the side of the apparatus, so that the operator must move from the front to the side to collect the copied sheets from the sorter. For that reason, it is inconvenient to handle the apparatus.

Further, the present invention relates to a color image forming apparatus which forms a color toner image on the surface of a belt-shaped image forming body, and transfers the image onto a transfer sheet.

There are various kinds of color image forming apparatus. In general, a color image forming apparatus is structured in the following manner:

A belt-shaped image forming body is provided around two rotating shafts; a plurality of developing units which accommodate toners of different colors, are disposed below the image forming body; while the photoreceptor belt is rotated a plurality of times, latent images, the number of which corresponds to that of the separated colors of a document image, are formed, and then developed by the developing units; and the formed color image is transferred onto a transfer sheet which is supplied from a cassette provided in a cassette chamber located under the developing units.

The photoreceptor belt of a color image forming apparatus is different from a photoreceptor drum. The photoreceptor belt can be curved around a roller, the radius of curvature of which is small. Accordingly, the photoreceptor belt can be made flat as a whole, so that the space can be used effectively. Further, when a separation electrode to separate a transfer sheet is provided in the portion where the radius of curvature is small, the transfer sheet can be positively separated from the photoreceptor belt. A group of developing units are stacked above the cassette chamber, and the photoreceptor belt is disposed on the group of developing units. A transfer sheet passage and a transfer sheet supply means which connects the cassette chamber with the transfer section of the photoreceptor belt, are provided along the side inner wall so that they do not interfere with the group of developing units. On the other hand, an opening through which the cassette is inserted, is formed in the side wall of the apparatus opposite to the transfer sheet supply passage and the supply means. Therefore, the transfer sheet cassette can be inserted into the cassette chamber in the same direction as the transfer sheet supply.

However, when the transfer sheet cassette is inserted into the cassette chamber from the opposite side to the transfer sheet passage and the transfer sheet supply means, it is necessary to structure the apparatus so that both side walls can be opened, because one side must be opened for jam clearance and the other side must be opened for supplying transfer sheets to the cassette. Therefore, a wide space is needed for installation of the apparatus, and further it is disadvantageous from the viewpoint of operation and maintenance.

In order to improve the aforementioned problems, it is desired to provide an image forming apparatus in which the transfer sheet inserting opening is formed on the same side as the transfer sheet passage so that jam clearance and maintenance can be carried out from the front of the apparatus.

However, in the image forming apparatus structured in the aforementioned manner, the mechanism to move and withdraw the transfer sheet supply means becomes complicated since the transfer sheet cassette inserting direction is opposite to the transfer sheet supply direction.

In the case of an apparatus which accommodates a plurality of cassettes, it is necessary to provide a guide member to guide upward a transfer sheet conveyed out from the lower cassette, so that this guide member must be concurrently moved and withdrawn when the cassette is attached to and detached from the apparatus. Accordingly, the mechanism becomes further complicated.

Further, a sorter provided on the upper portion of the transfer sheet guide is desirably operated from the same side of the image forming apparatus.

SUMMARY OF THE INVENTION

The first object of the present invention is to provide a sheet discharging device of an image forming apparatus characterized in that: selection can be positively made between face-down and face-up discharging by a simple operation; the structure is simple; and the cost is low.

The second object of the present invention is to provide an image forming apparatus having a sorter which can select either side of a transfer sheet by a very simple structure.

The third object of the present invention is to provide an image forming apparatus characterized in that all the following operations can be carried out by an operator standing in front of the apparatus: an attaching and detaching operation of a cartridge including a photoreceptor in which the functions of charging, developing, transferring and cleaning are incorporated; an attaching and detaching operation of a transfer sheet cassette; a collecting operation of transfer sheets discharged on a sorter; and a maintenance operation.

In order to accomplish the first object, the present invention is to provide a sheet discharging device of the first structure in which a toner image transferred onto a transfer sheet is fixed by a fixing means and the transfer sheet is discharged onto a discharge tray, and the sheet discharging device comprises: the first transfer sheet discharging means which discharges a transfer sheet with the toner image side of the transfer sheet face-down; the first discharging tray which receives the transfer sheet discharged from the first discharging means; the second transfer sheet discharging means which discharges a transfer sheet with the toner image side face-up; the second discharging tray which receives the transfer sheet discharged from the second discharging means; and a rotation means to rotate the first and second discharging trays. In the sheet discharging device of the first structure, the changeover operation between the first and second transfer sheet discharging means is being linked with the operation of the rotation means to rotate the first and second discharging trays.

In order to accomplish the second object, the present invention is to provide an image forming apparatus of the second structure which is provided with a sorter for sorting transfer sheets in the order of copying, and the image forming apparatus is characterized in that: a plurality of bins composing the sorter are structured to be reversible so that the transfer sheet can be discharged either face-up or face-down.

The third structure of the present invention is achieved by the following technical means (a) or (b).

(a) An image forming apparatus provided with a sorter which is disposed approximately at the same level as the upper surface of the apparatus, wherein the transfer sheets discharged from the apparatus are vertically sorted face-up.

(b) An image forming apparatus provided with the sorter according to item (a), wherein the sorter can be horizontally shifted by a predetermined distance in a direction perpendicular to that of transfer sheet conveyance.

The fourth structure of the present invention can be accomplished by either of the following technical means (a) or (b).

(a) The transfer sheet cassette in which transfer sheets are accommodated, and the cartridge in which the photoreceptor unit is provided, are moved in the same direction and detached from the apparatus through openings formed on the same side. A sorter is provided in the upper portion of the image forming apparatus on the same side as the openings, and the side on which the openings are provided is the same as the front side of the apparatus, wherein the apparatus is operated by an operator from the front side.

(b) The sorter sorts the transfer sheets face-down.

BRIEF DESCRIPTION OF THE DRAWINGS

FIG. 6 (*b*) is a view showing circumstances in which a transfer sheet is discharged face-up by the device shown in FIG. 5;

DETAILED DESCRIPTION OF THE PREFERRED EMBODIMENTS

With reference to FIG. 1 to FIG. 4, an example of the transfer sheet discharging device of the present invention is explained as follows.

Figure 1:
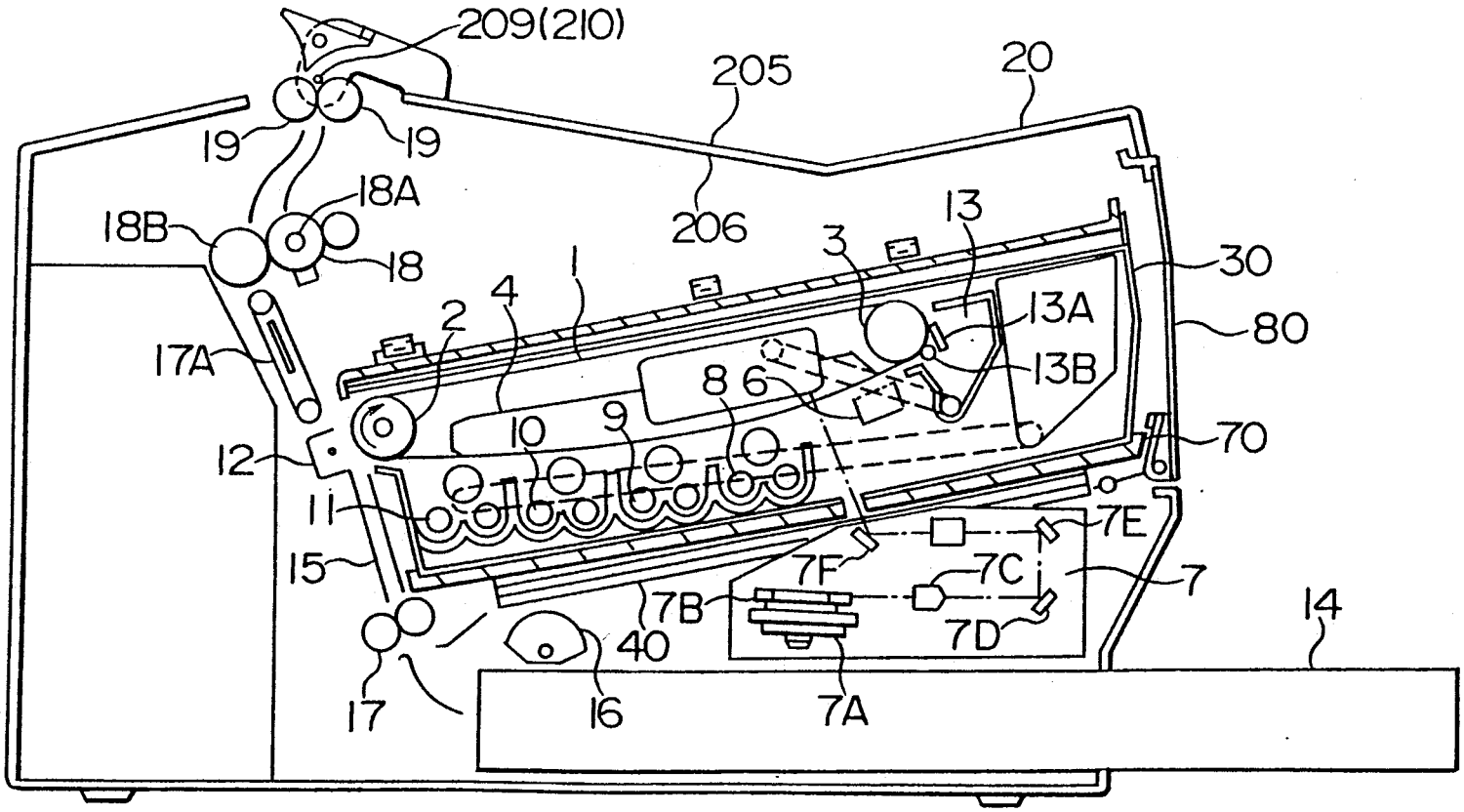
FIG. 1 is a view showing a transfer sheet discharging device of an image forming apparatus to which a discharging tray is provided under the condition of the first transfer sheet discharging means.

FIG. 1 is a view showing circumstances in which the first transfer sheet discharging tray is provided to the first transfer sheet discharging means which discharges a transfer sheet under the condition that the toner image side of the transfer sheet is set downward, which is referred to as face-down discharging, hereinafter.

Numeral 1 is a flexible photoreceptor belt which is a belt-shaped image carrier. The photoreceptor belt 1 is provided around the rotating rollers 2 and 3, and is conveyed clockwise in the direction of an arrow mark illustrated on the rotating roller 2 in the drawing.

Numeral 4 is a guide member which is fixed to the apparatus body so that the guide member 4 is in contact with the inner surface of the photoreceptor belt 1. When the photoreceptor belt 1 is given tension by the rotating roller 3 which is pushed outside, the inner circumferential surface of the photoreceptor belt 1 slidably comes into contact with the guide member 4.

Consequently, the photoreceptor provided on the outer circumferential surface of the photoreceptor belt 1 can be always maintained at a constant position with regard to the surface of the guide member 4, so that a stable image forming surface can be always formed.

Numeral 6 is a scorotron charger which is a charging means. Numeral 7 is a laser writing system unit which is an image exposure means. Numerals 8 to 11 are a plurality of developing units in which specific colors are accommodated. These image forming means are provided along the outer circumferential surface of the photoreceptor belt 1, the inner circumferential surface of which is opposed to the guide member 4.

Not only the optical type of laser writing system unit 7 illustrated in the drawing but also an optical system in which a light emitting section and a convergent light transmitter are unified, is utilized.

The developing units 8, 9, 10, 11 accommodate, for example, developers of black, cyan, magenta, and yellow. The developing units are provided with a developing sleeve, and a predetermined gap is formed between the developing sleeve and the photoreceptor belt 1, so that a latent image on the photoreceptor 1 is developed into a visual image by the non-contact developing method. This non-contact developing method has an advantage that the movement of the photosensitive belt is not disturbed, which is unlike the contact developing method.

Numeral 12 indicates a transfer unit. Numeral 13 indicates a cleaning unit. A blade 13A of the cleaning unit 13 and a cleaning roller 13B are kept away from the surface of the photoreceptor belt 1 during image formation, and pressed onto the surface of the photosensitive belt 1 as shown in FIG. 1 only when the surface is cleaned after image transfer.

The color image forming process of the above color image forming apparatus is conducted as follows.

First, a multi-color image is formed by an image forming system described below in this example. Data obtained by a color image data input unit when an original image is scanned by image pick-up elements, is processed by an image data processing unit so as to create image data, and the image data is stored temporarily in an image memory. The image data is retrieved for recording and inputted into a recording unit, for example, the color image forming apparatus shown in the example in FIG. 1.

When a color signal outputted from an image reader which is different from the aforementioned image forming apparatus, is inputted into the laser writing system 7, a laser beam generated by a semiconductor laser (not shown in the drawing) is rotationally scanned by a polygonal mirror 7B which is rotated by a drive motor 7A in the laser writing system unit 7, and the optical path of the laser beam is curved by mirrors 7D, 7E and 7F through $f\theta$ lens 7C. Then, the laser beam is irradiated onto the peripheral surface of the photosensitive belt 1 which is electrically charged beforehand by the charging unit 6 which is a charging means so as to form a bright line.

When scanning starts, the beam is detected by an index sensor, the beam by the first color signal starts modulation, and the modulated beam scans on the peripheral surface of the photosensitive belt 1. Therefore, a latent image corresponding to the first color is formed on the peripheral surface of the photosensitive belt 1 by the primary scanning of the laser beam and by the auxiliary scanning by the movement of the photosensitive belt 1. This latent image is developed by the developing unit 8 of the developing means containing black (BK) toner and a toner image is formed on the photoreceptor belt surface. The toner image formed on the photoreceptor belt surface passes under the cleaning unit 13 which is separated away from the peripheral surface of the photosensitive belt 1, and then the process enters the next copy cycle. Black (BK) toner has the spectral characteristics in which infrared rays are transmitted so that semiconductor laser light can be transmitted.

The photoreceptor belt 1 is charged by the charging means 6 once again, and the second color signal outputted from the signal processing unit is inputted into the laser writing system 7. Then, data is written on the photoreceptor belt surface in the same manner as the aforementioned case of the first color signal so as to form a latent image. The latent image is developed by the developing unit 9 containing cyan (C) toner as the second color.

This cyan (C) toner image is formed on the aforementioned black (BK) toner image which has already been formed, wherein the cyan toner image is accurately superimposed on the black toner image being synchronized by a registration signal.

In the same manner, a magenta (M) latent image is formed on the photoreceptor belt surface according to a control signal generated by the signal processing section. The latent image is developed by the developing unit 10 containing toner of magenta (M) which is the third color. The magenta (M) toner image is synchronously superimposed on the aforementioned toner image. Numeral 11 is a developing unit containing yellow (Y) toner. In the same manner as explained above, a yellow toner image is formed on the surface of the photoreceptor belt. A DC or AC bias voltage is impressed upon each sleeve of the developing units 8, 9, 10 and 11, and then jumping development is performed by a 2-component developer which is a developing means, and non-contact development is performed on the photoreceptor belt 1, the base of which is grounded. In this case, non-contact development using a 1-component developer may be performed.

At the transfer unit, color toner images formed on the peripheral surface of the photoreceptor belt 1 are transferred onto a transfer sheet which is sent from a sheet feed cassette 14 through a sheet feed guide 15.

The uppermost transfer sheet accommodated in the sheet feed cassette 14, is conveyed when a sheet feed roller 16 is rotated. Then, the transfer sheet is fed to the transfer unit 12 through timing rollers 17 synchronously with the image formation on the photoreceptor belt 1.

The transfer sheet onto which an image has been transferred, is positively separated from the photoreceptor belt 1 which is sharply curved around the rotating roller 2 and moved upward through a suction type of conveyor belt 17A. The transfer sheet is pinched by a fixing roller 18 heated by a heater 18A, and a press roller 18B so that the toner image is thermally fixed.

After that, the transfer sheet is discharged through a discharge roller 19 onto the first sheet discharging tray 205 formed on the upper cover 20.

The photoreceptor belt 1, after image transfer to the transfer sheet has been completed, continues to move, and remaining toner is removed by the cleaning unit 13 wherein the blade 13A and the roller 13B are pressed to the belt. Then, the blade 13A is separated from the belt once again, the roller 13B smooths toner accumulated on the tip of the blade 13A a little later, the roller is separated from the belt, and the apparatus enters a new image forming process.

The photoreceptor belt 1, charging unit 6, developing units, and cleaning unit 13 are incorporated and integrated into an independent process cartridge 30 as process supplies for image forming, and those units are integrally attached to and detached from the apparatus body.

In the apparatus, there is provided a carriage 70, the bottom portion of which is engaged with a pair of fixed guide rails 40, and the process cartridge 30 is mounted on the carriage 70 so as to be accommodated in the apparatus. In the case of replacement of the process cartridge or jam clearance, a side cover 80 is opened and the process cartridge 30 is pulled out, and further the upper 20 is opened upward to removed jammed transfer sheets.

Figure 2:
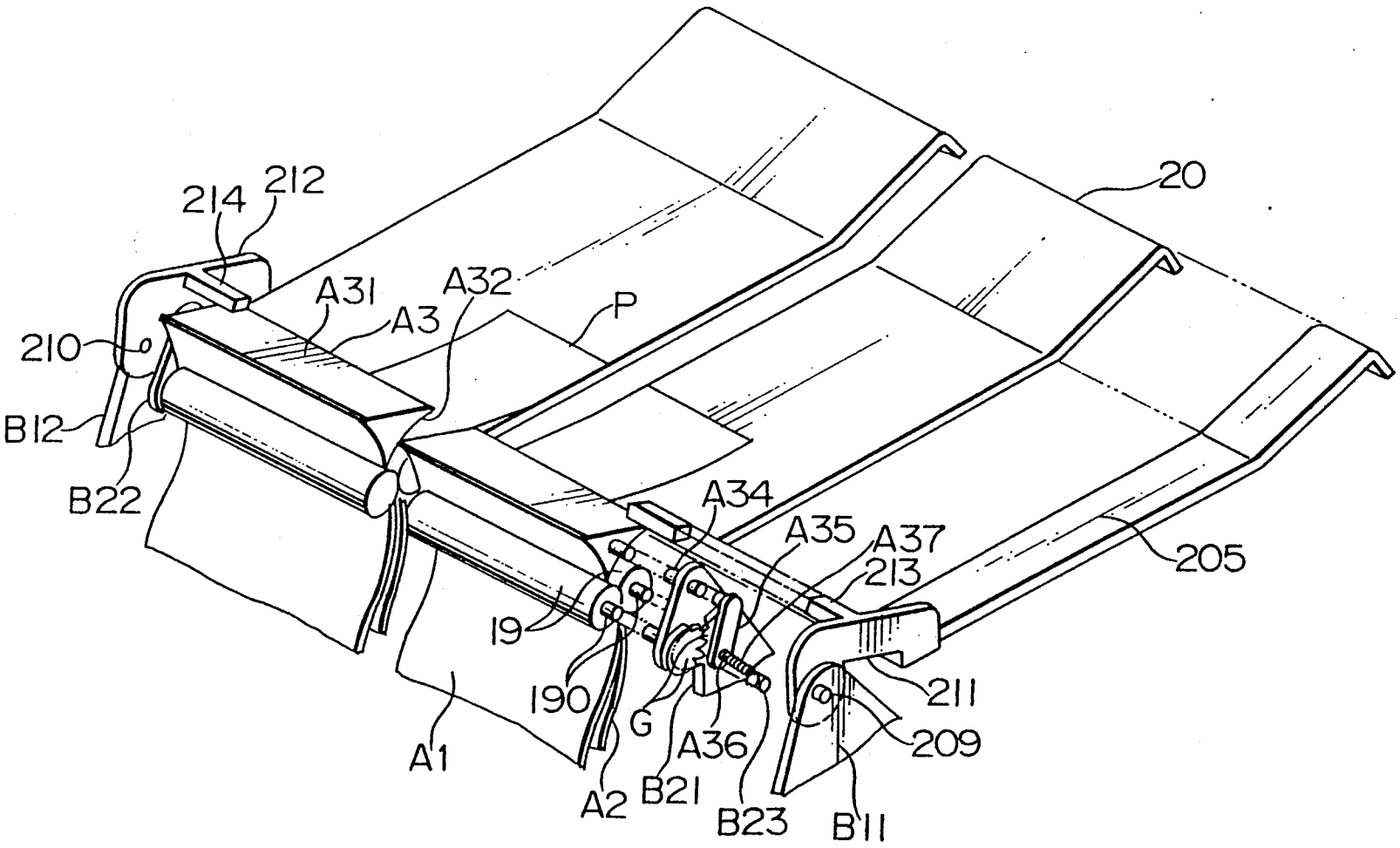
FIG. 2 is a perspective view of the transfer sheet discharging device shown in FIG. 1.

With reference to FIG. 2, the transfer sheet discharging means of face-down discharging such as the first transfer sheet discharging means, the first transfer sheet discharging tray and the rotating means will be explained as follows.

FIG. 2 is a perspective view of the essential portion of the transfer sheet discharging device shown in FIG. 1. As shown in FIG. 1, the first transfer sheet discharging tray 205 is provided under the condition of the first transfer sheet discharging means. Accordingly, FIG. 2 shows the transfer sheet discharging means under the condition of the first transfer sheet discharging means.

Numeral 205 is the first transfer sheet discharging tray which receives transfer sheet P which has been discharged face-down. There are provided transfer sheet discharging tray arms 211, 212 on both sides of the first transfer sheet discharging tray 205, and transfer sheet discharging tray rotating shafts 209, 210 to rotate the first transfer sheet discharging tray are provided at the tips of the transfer sheet discharging tray arms 211, 212. The transfer sheet discharging tray rotating shafts 209, 210 are engaged in holes formed in brackets B11, B12 provided to the apparatus body so that the first transfer sheet discharging tray 205 can be rotated around the transfer sheet discharging tray rotating shafts 209, 210.

There are provided brackets B21, B22 in the image forming apparatus body. A guide bar rotating shaft A34 of a guide bar A3, and transfer sheet discharging roller shafts 190 of two transfer sheet discharging rollers 19, are engaged in holes formed in brackets B21, B22 so that guide bar A3 and two transfer sheet discharging rollers 19 are rotatably supported by the brackets.

A guide bar arm A35 is mounted on the end of the guide bar rotating shaft A34 which penetrates through bracket B21 as shown in FIG. 2. A guide bar spring A37 is provided between a pin A36 mounted on guide bar arm A35 and a pin B23 mounted on bracket B21, wherein guide bar spring A37 is extended. Guide bar holding members 213, 214 respectively mounted on the transfer sheet discharging tray arms 211, 212 push an upper surface A31 of guide bar A3 as shown in FIG. 2, wherein the guide bar holding members 213, 214 push the right end portion of the short side of upper surface A31. Accordingly, guide bar A3 is rotated clockwise a little. Consequently, guide bar rotating shaft A34 is rotated, and guide bar arm A35 mounted on guide bar rotating shaft A34 is rotated to the position shown in FIG. 2. As a result, guide bar spring A37 provided between pins A36 and B23, are extended as shown in the drawing. In the case where guide bar holding members 213, 214 do not push guide bar upper surface A31, pin A36 of guide bar arm A35 is pulled by the tension generated by guide bar spring A37. Therefore, guide bar arm A35 is rotated counterclockwise, so that the axes of guide bar rotating shaft A34, pin A36 and pin B23 are aligned on a straight line. However, when the guide bar holding members 213, 214 push guide bar upper surface A31 in the manner mentioned before, the axes of guide bar rotating shaft A34, pin A36 and pin B23 which are aligned on a straight line, are moved, so that they are aligned on a C-shaped line. Therefore, guide bar spring A37 provided between pins A36 and B23, is extended. As described above, guide bar A3 is rotated clockwise, and curved guide surface A32 faces pressure contact portions of two transfer sheet discharging rollers 19 as shown in FIG. 2.

Gears G are provided to the end portions of two transfer sheet discharging roller shafts 190 which protrude through bracket B21, wherein gears G are meshed with each other and rotated in the opposite direction so that the two transfer sheet discharging rollers discharge transfer paper P upward. Further, a gear train (not shown) is provided which drives the transfer sheet discharging rollers 19 in the aforementioned manner.

As shown in FIG. 2, guide plates A1, A2 are provided in such a manner that they face the pressure contact portions of the two transfer sheet discharging rollers 19. Transfer sheet P, the side on which a toner image is formed is disposed right, is guided to a gap formed by guide plates A1 and A2, and conveyed to the pressure contact portion of the two transfer sheet discharging rollers 19. Then, transfer sheet P is conveyed upward by the two rollers 19, and the leading edge of transfer sheet P collides with guide surface A32 of guide bar A3. Then, transfer sheet P is sent along curved guide surface A32. Finally, transfer paper P is discharged face-down onto the first transfer sheet discharging tray 205, which is the first transfer sheet discharging means.

Figure 3:
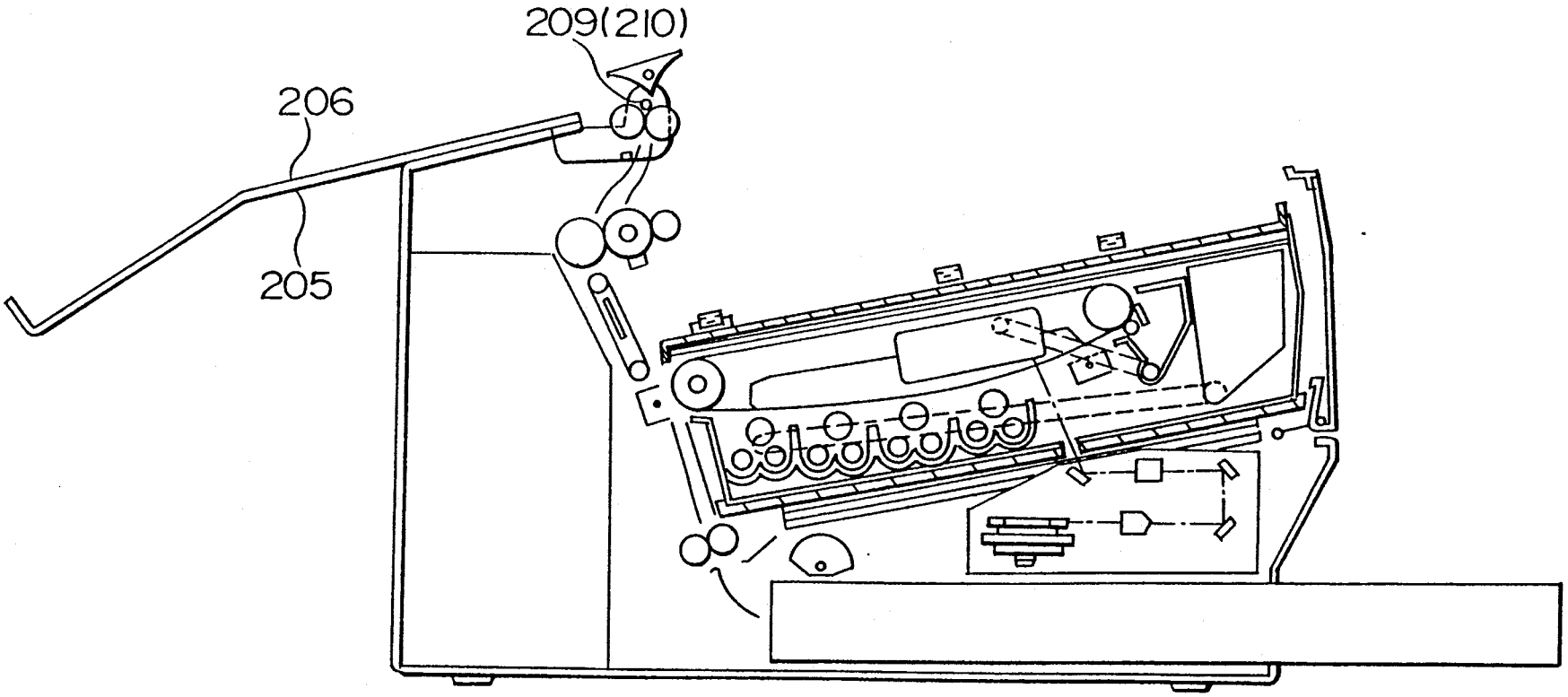
FIG. 3 is a view showing a transfer sheet discharging device of an image forming apparatus to which a discharging tray is provided under the condition of the second transfer sheet discharging means.

FIG. 3 shows circumstances of the second transfer sheet discharging means in which the second transfer sheet discharging tray is provided, wherein transfer sheets are discharged face-up so that the toner image side of transfer sheet is set upward.

The second transfer sheet discharging tray 206 is provided on the reverse side of the first transfer sheet discharging tray 205. When the transfer sheet discharging tray is rotated counterclockwise around the transfer sheet discharging tray rotating shaft 209 from the position illustrated in FIG. 1 to the position illustrated in FIG. 3, the apparatus becomes the state of the second transfer sheet discharging means.

Figure 4:
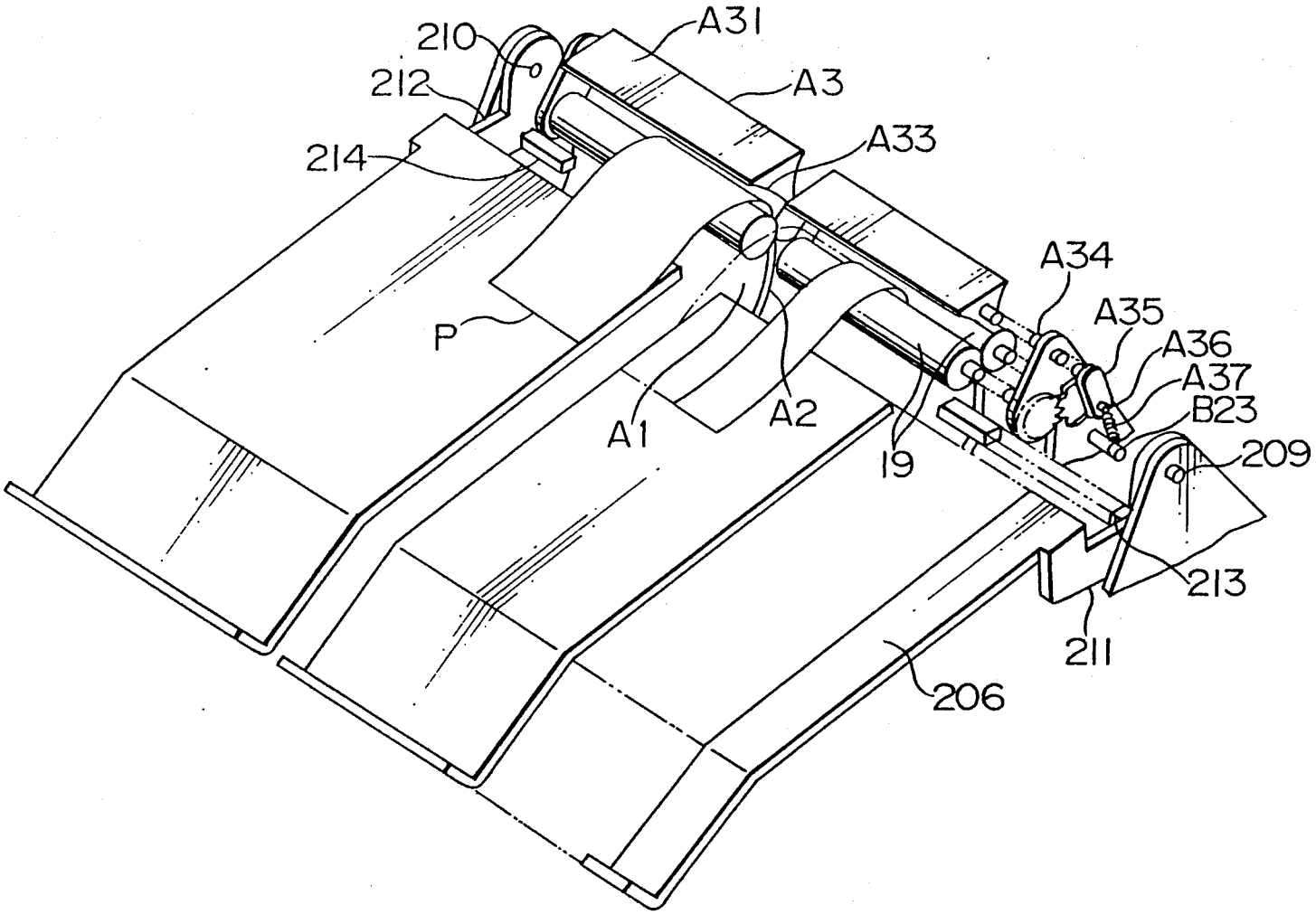
FIG. 4 is a perspective view of the transfer sheet discharging device shown in FIG. 3.
Figure 5:
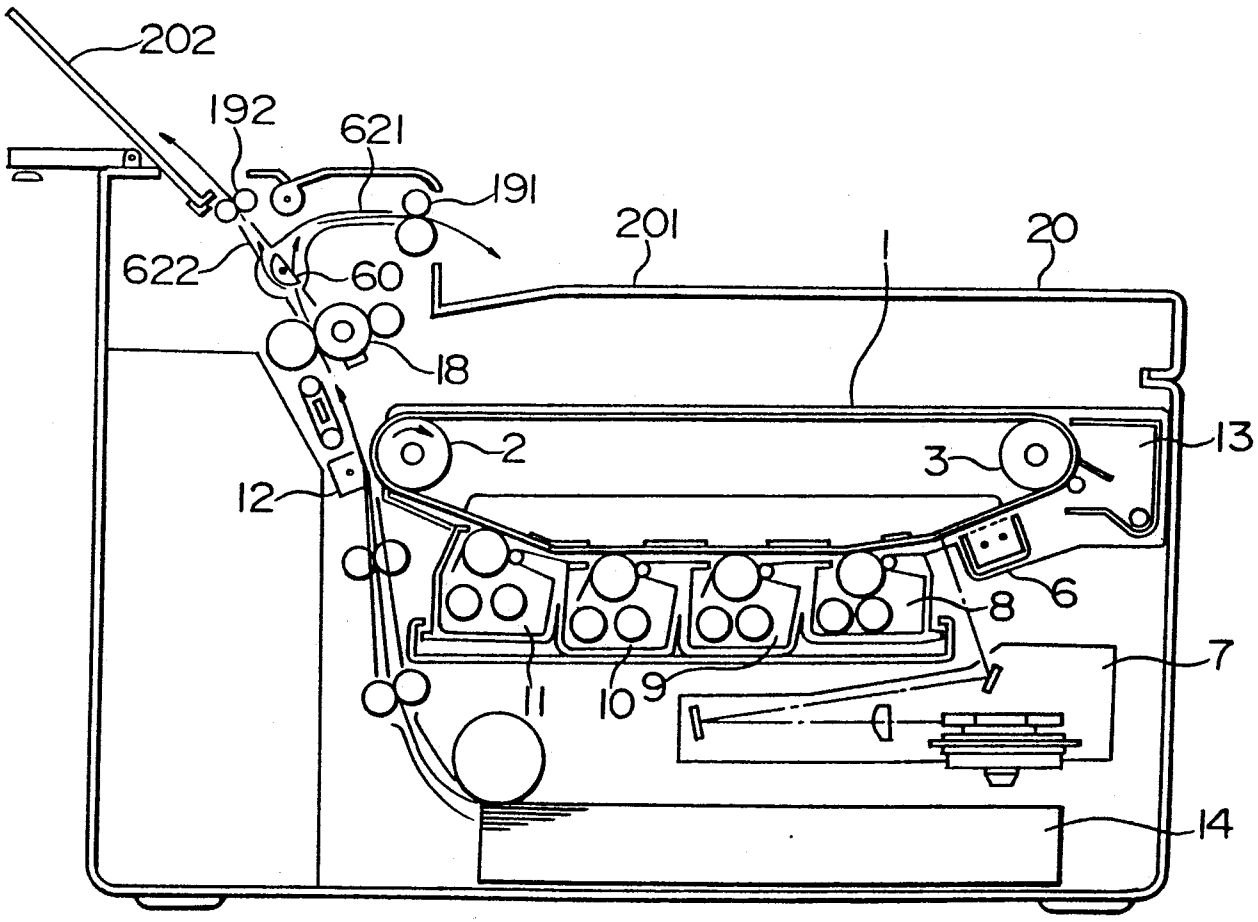
FIG. 5 PRIOR ART
FIG. 5 is a view showing a transfer sheet discharging device of a conventional image forming apparatus.
Figure 6:
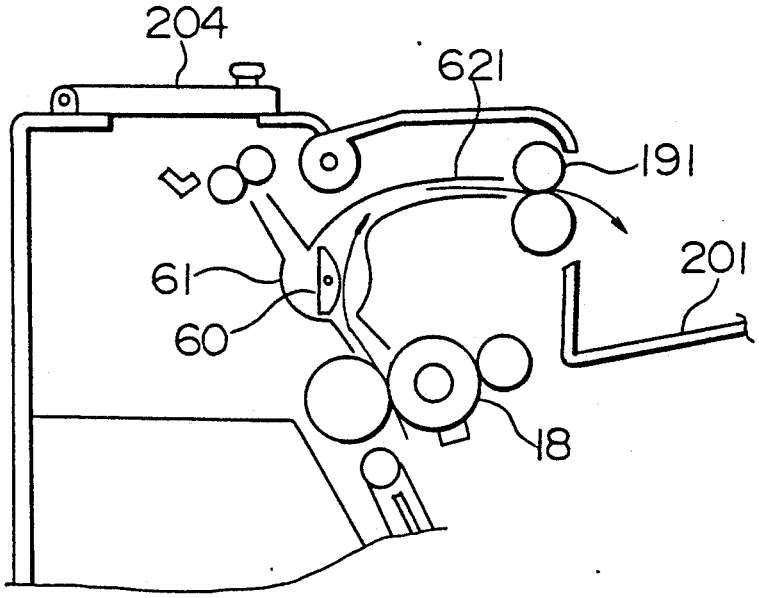
FIG. 6 (a) PRIOR ART
FIG. 6 (*a*) is a view showing circumstances in which a transfer sheet is discharged face-down by the device shown in FIG. 5.
Figure 6:
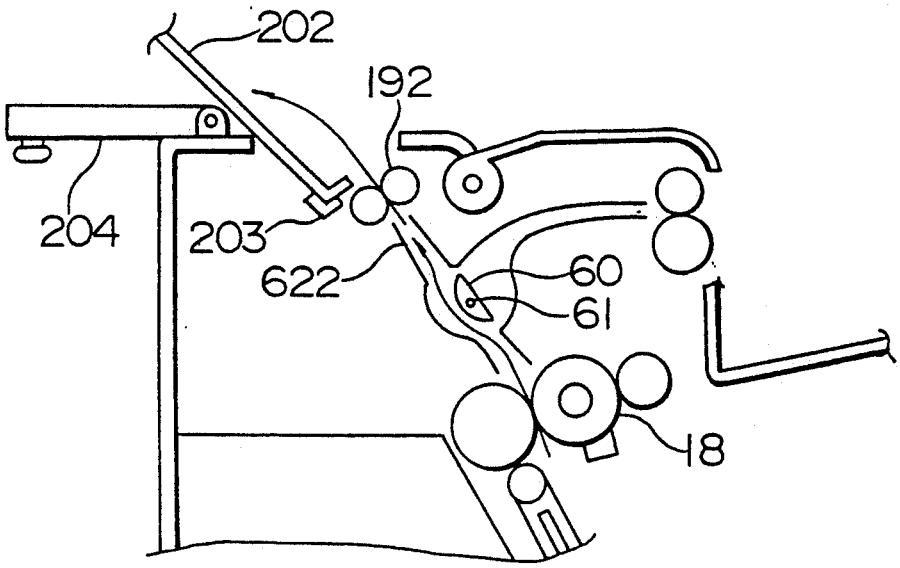
FIG. 6 (b) PRIOR ART

Next, with reference to FIG. 4, the second transfer sheet discharging means, the second transfer sheet discharging tray and the rotation means are explained which are provided for discharging transfer sheets face-up.

FIG. 4 is a perspective view of an essential portion of the transfer sheet discharging device shown in FIG. 3.

Numeral 206 is the second transfer sheet discharging tray which is provided on the reverse side of the first transfer sheet discharging tray 205, whereby the second transfer sheet discharging tray receives transfer sheet P which has been discharged face-up. The rotation means is common to the first and second transfer sheet discharging trays. Therefore, the explanation will be omitted here.

When the second transfer sheet discharging tray 206 is set at the position shown in FIG.4, the guide bar holding members 213, 214 are moved to a position where upper surface A31 of the guide bar is not pressed as shown in FIG. 4. Pin A36 mounted on guide bar arm A35 provided to guide bar rotating shaft A34, is pulled by the tension generated by guide bar spring A37. Then, guide bar arm A35 is rotated counterclockwise, and the axes of guide bar rotating shaft A34, pin A36 and pin B23 are aligned on a straight line as shown in FIG. 4. Accordingly, guide bar A3 is also rotated counterclockwise, and curved guide surface A33 faces the pressure contact portions of the two transfer sheet discharging rollers 19 as shown in FIG. 4.

Transfer sheet P, the side on which a toner image is formed is disposed right, is guided to a gap formed by guide plates A1 and A2, and conveyed to the pressure contact portion of the two transfer sheet discharging rollers 19. Then, transfer sheet P is conveyed upward by the two rollers 19, and the leading edge of transfer sheet P collides with guide surface A33 of guide bar A3. Then, transfer sheet P is sent along curved guide surface A33. Finally, transfer paper P is discharged face-down onto the second transfer sheet discharging tray 206, which is the second transfer sheet discharging means.

According to the present invention, when a simple rotating operation of the transfer sheet discharging tray is carried out, changeover between face-down-discharging and face-up-discharging can be positively conducted. Accordingly, a simple structured transfer sheet discharging device of an image forming apparatus can be provided at a low cost.

Figure 7:
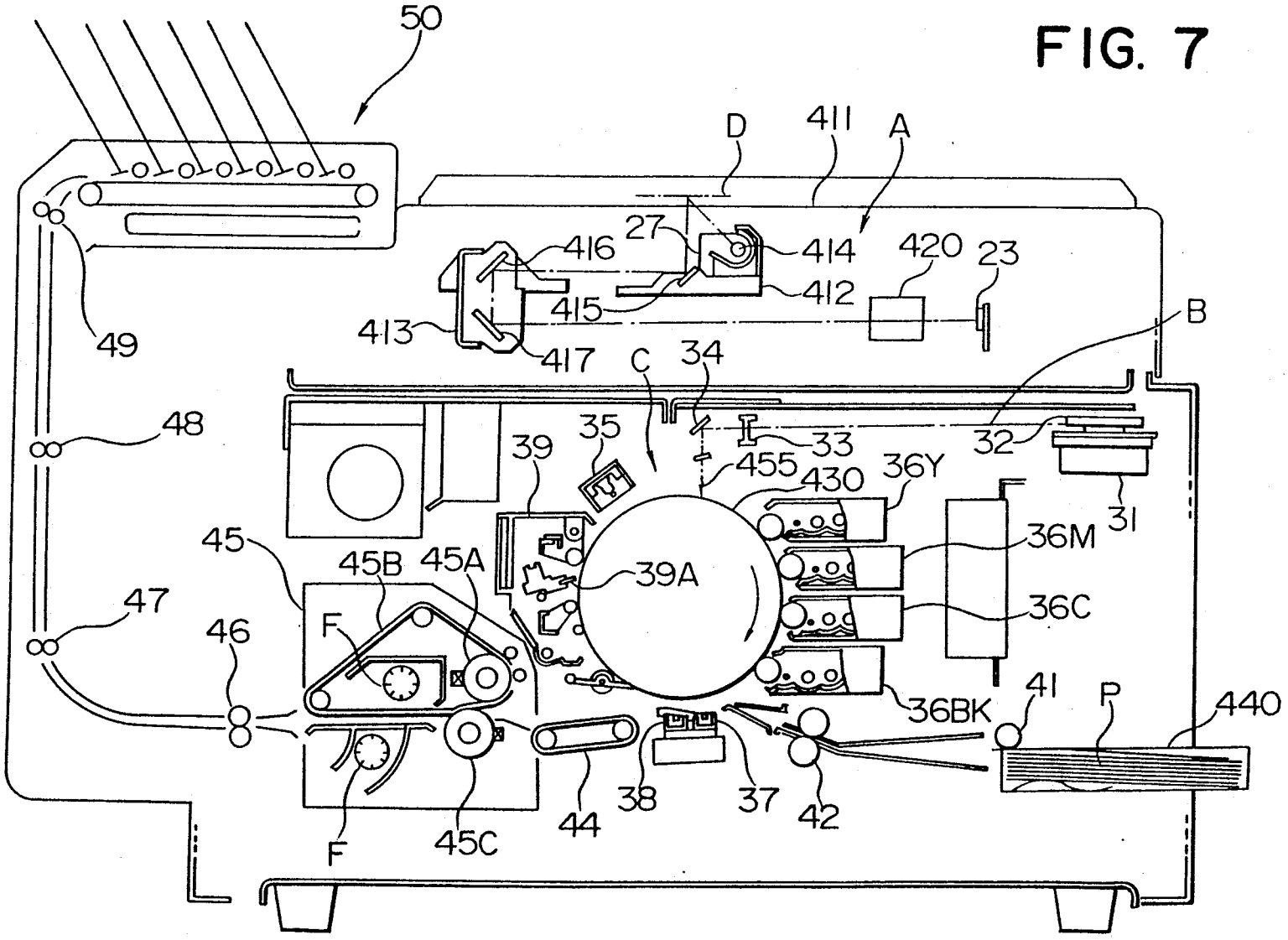
FIG. 7 is a sectional view of the image forming apparatus of the present invention.
Figure 8:
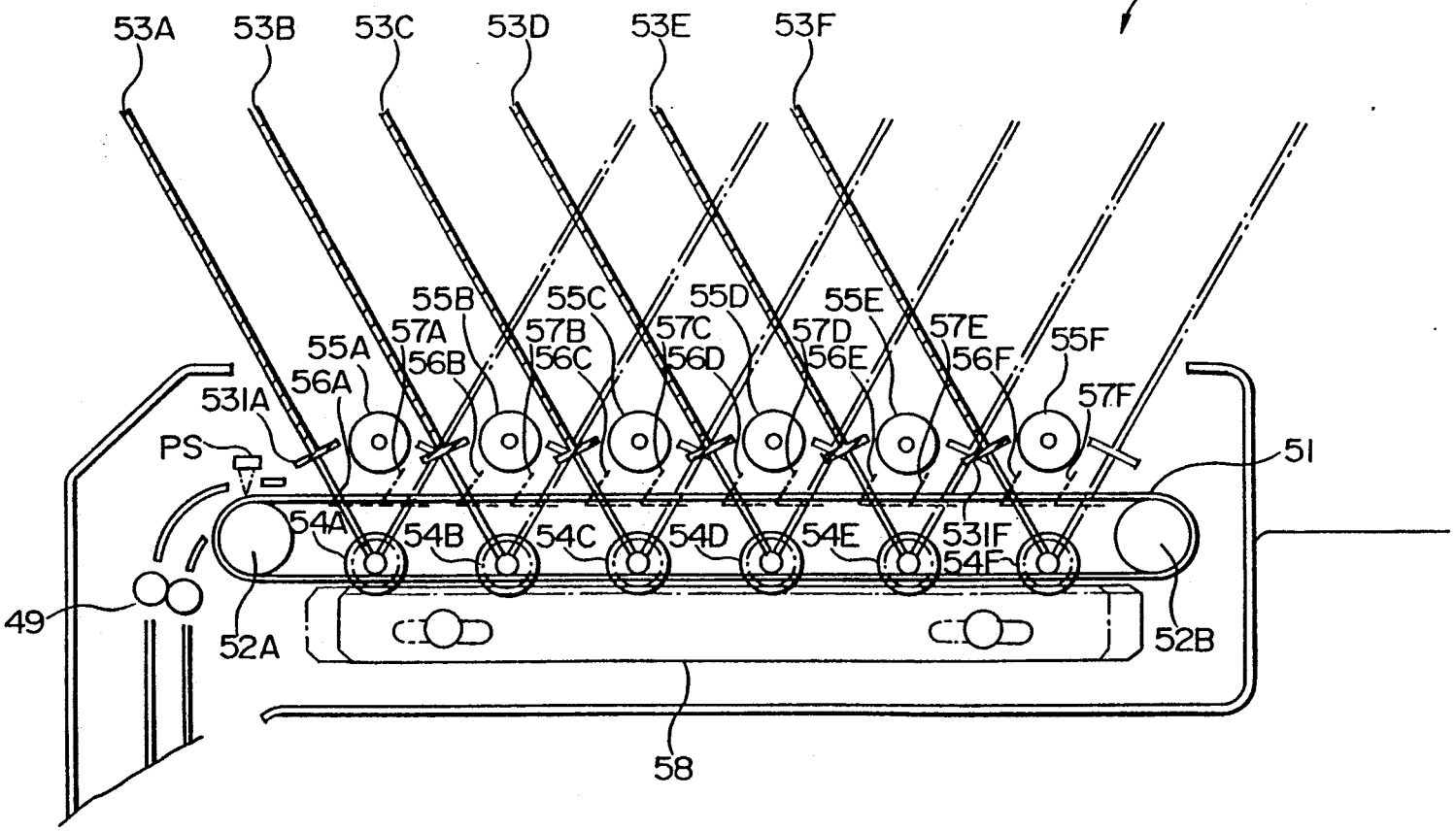
FIG. 8 is a sectional view of a sorter provided to the image forming apparatus of the present invention.
Figure 9:
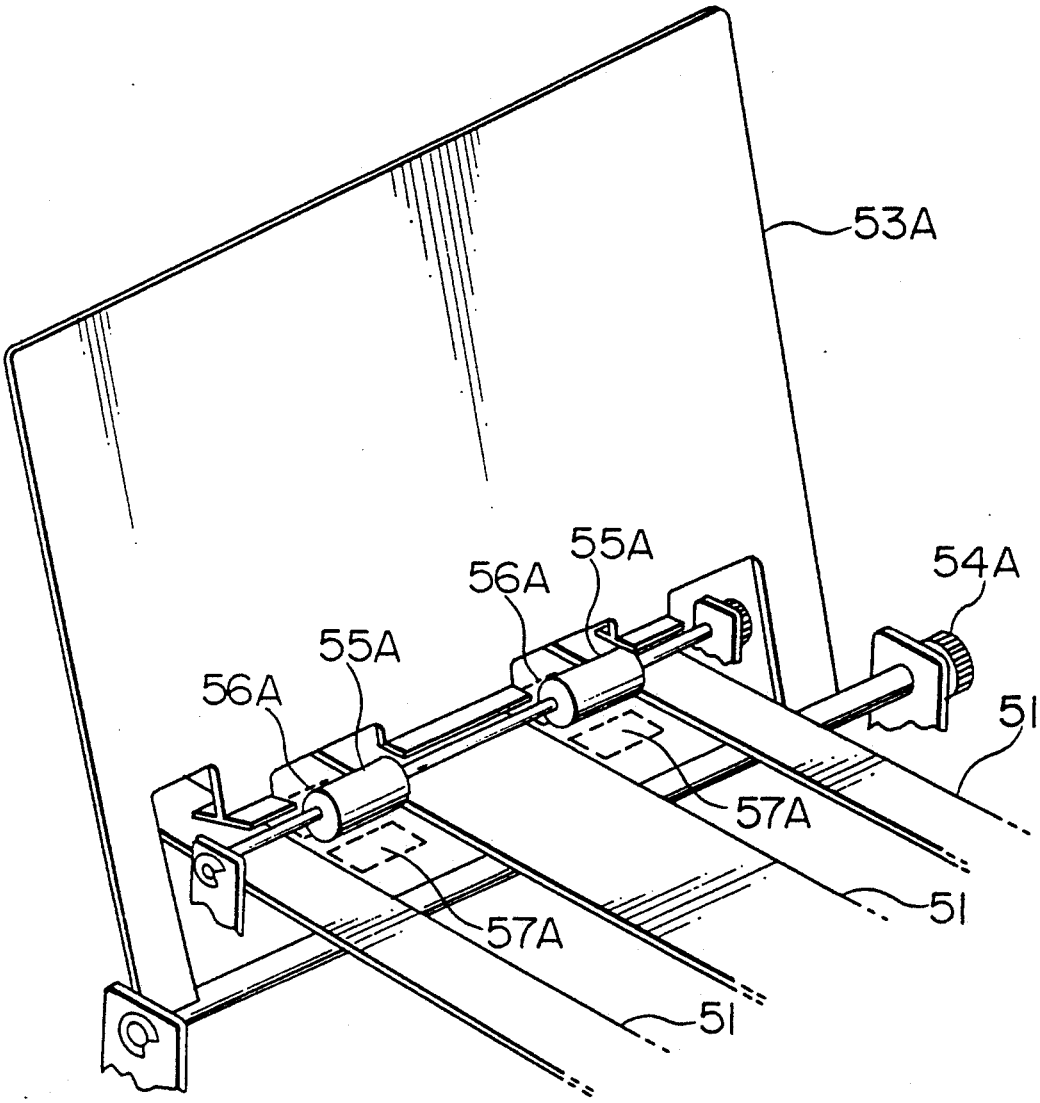
FIG. 9 is a perspective view of an essential portion of the sorter.

Another example of the present invention is shown in FIGS. 7, 8 and 9.

FIG. 7 is a sectional view showing an example of the color image forming apparatus according to the present invention. This image forming apparatus includes image reading system A, laser writing system B and image forming section C.

In the upper portion of the image forming apparatus, there is provided a platen unit 411 including a platen made of transparent glass, a document cover which covers document D placed on the platen, and the like. Under the platen unit, there is provided image reading system A including the first mirror unit 412, the second mirror unit 413, a main lens 420, a color CCD 23, and the like. The first mirror unit 412 is provided with an exposure lamp 414 and the first mirror 415, and can be linearly moved in the longitudinal direction of the apparatus in parallel with the platen, so that all the surface of document D can be optically scanned. The second mirror 416 and the third mirror 417 are incorporated into the second mirror unit 413, wherein the second mirror unit 413 is linearly moved in the same direction as the first mirror unit 412 at half speed of the first mirror unit 412 so that a predetermined optical path length can be maintained. Of course, this second mirror unit 413 is moved in parallel with the platen in the same manner as the first mirror unit 412. The image of document D placed on the platen is exposed to the light emitted from the exposure lamp 414, and the exposed image is formed on a color CCD 23 by the main lens 420 through the first, second and third mirrors 415, 416 and 417. After the scanning operation has been completed, the first and second mirror units 412 and 413 are returned to their initial positions and waits for the next copy operation.

Image data of each color obtained by the color CCD 23, is image-processed, and outputted from laser writing system B as an image signal.

Image forming section C includes: a charger 35, image exposing section 455, developing units 36Y, 36M, 36BK, transfer unit 37, separator 38, and cleaning unit 39, wherein the aforementioned units are disposed around a photoreceptor drum 430 which is an image forming body; and a transfer sheet feeding cassette 440, conveyance belt 44, and fixing unit 45, wherein the aforementioned units are disposed close to the photoreceptor drum 430.

The developing units 36Y, 36M, 36C and 36BK are disposed around the photoreceptor drum 430 in the following manner: the developing unit 36Y is disposed in the most upstream portion; and the developing unit 36BK containing black toner BK is disposed in the most downstream portion. Conventional toners are used for color toners accommodated in the developing units 36Y, 36M, 36C, and black toner accommodated in the developing unit BK. Therefore, explanations are omitted here.

When a copy button is pressed by an operator, each process of image reading system A, laser writing system B and image forming section C is started so that a color image is formed. When an image signal sent from image reading system A is inputted by a CPU into writing system B including a drive motor 31, polygonal mirror 32, semiconductor laser not shown, fθ lens, and correction lens, a copy operation is started. That is, the photoreceptor drum 430 is rotated clockwise, and uniformly given an electrical charge. Then, in the image exposure section 455, a yellow (Y) image corresponding to the image of document D is written on the photoreceptor drum 430 by the laser beams of laser writing system B, so that an electrostatic latent image corresponding to the yellow image is formed. The electrostatic latent image on the photoreceptor drum 430 is developed in the manner of reversal development by the developing unit 36Y with Y toner so that the electrostatic latent image is visualized to a toner image. That is, development is carried out in the following manner: a developing sleeve of the developing unit 36Y in which a magnetic roller is provided, is given a DC and further AC bias voltage; and non-contact development is conducted by a 2-component developer so that a Y-toner image is formed. The photoreceptor drum 430 on which the Y-toner image is formed, passes under the cleaning unit 39 which has already been withdrawn. Then, the photoreceptor drum 430 is electrically charged by the charger 35, and magenta (M) image is written with laser beams by laser writing system B, so that an electrostatic latent image of magenta (M) is formed on the aforementioned Y-toner image. This latent image is developed in the manner of reversal development by the developing unit 36M containing magenta toner so that the latent image becomes an M-toner image. Successively, a cyan (C) toner image and a black (BK) toner image are formed and superimposed in the same manner.

When the image of document D is monochromatic, only the developing unit 36BK is operated so that a toner image composed of only black toner BK is formed on the photoreceptor drum 430.

Next, transfer sheets P are supplied from the transfer sheet cassette 440 one by one. Transfer sheet P is conveyed onto the photoreceptor drum 430 by the timing roller 42 which is operated synchronously with the toner image formation conducted on the photoreceptor drum 430. The toner image is transferred onto transfer sheet P by the action of the transfer unit 37. After that, transfer sheet P is separated from the surface of the photoreceptor drum 430 by the separator 38, and then transfer sheet P is conveyed face-up to the fixing unit 45 through the conveyance belt 44.

Both sides of transfer paper P conveyed to the fixing unit 45 are heated in the nip section which is formed by the heat belt 45B wound around the heating roller 45A, and the pressure roller 45C, so that the toner image is fused. After that, the fused toner image is cooled by upper and lower fans F, the cooling speed of which is controlled so that a lustrous image can be provided.

After the image has been fixed by the fixing unit 45, transfer sheet P is discharged to the transfer sheet discharging section through the transfer sheet discharging roller 46. On the other hand, the photoreceptor drum 430 continues to rotate, and the residual toner left on its surface is cleaned and collected by the cleaning unit 39 having the cleaning blade 39A which has been released from withdrawal.

Transfer sheet P discharged to the transfer sheet discharging section is conveyed toward a sorter 50 provided on the upper portion of the apparatus, through conveyance rollers 47, 48 and 49.

Detail of the structure of the sorter 50 is shown in FIG. 8. Numeral 51 is a conveyance belt wrapped around a drive roller 52B and an idle roller 52A. The conveyance belt 51 is always circulated clockwise by the drive roller 52B which is driven clockwise.

For example, as shown in FIG. 9, the conveyance belt 51 is composed of 3 belts, the width of which is limited, and disposed in parallel at predetermined intervals.

Numerals 53A to 53F are bins in which transfer sheets P are accommodated. Lower end portions of the bins are connected with rotating shafts of gears 54A to 54F at both outsides of the conveyance belt 51. Accordingly, when the gears 54A to 54F are rotated clockwise, the bins are rotated from the position illustrated by a solid line to the position illustrated by a one-dotted chain line.

The gears 54A to 54F are meshed with a rack 58, and when the rack 58 is horizontally moved, they are concurrently rotated so that the bin positions are determined.

Numerals 55A to 55F are transfer sheet discharging rollers which can be rotated normally and reversely. Numerals 56A to 56F and numerals 57A to 57F are guide plates which can be rotated as shown by an arrow mark from the position illustrated by a broken line to the position illustrated by a solid line or a one-dotted chain line.

FIG. 9 is a view showing the relation of the conveyance belt 51, transfer sheet discharging roller 55A, guide plate 56A and guide plate 57A with regard to the bin 53A.

Next, the transfer sheet discharging operation will be explained which is conducted on the sorter 50.

Transfer sheet discharging mode (A) in which transfer sheet P is discharged face-up, is selected by a control panel (not shown) of the image forming apparatus. Then, the conveyance belt 51 starts rotating, and at the same time the transfer sheet discharging rollers 55A to 55F are normally rotated all at once. That is, they are rotated clockwise. On the other hand, when a drive unit to drive the rack 58, for example, a motor (not shown) is maintained in the state of OFF, the bins 53A to 53F are maintained in the position illustrated by a solid line.

The first transfer sheet P on which the image of the first page is recorded, is conveyed by the conveyance belt 51, and its leading edge is detected by photo-sensor PS. Then, the guide plate 56A is raised by the action of a solenoid as shown by a solid line in FIG. 8, so that transfer sheet P is directed to that direction, and transfer sheet P is guided along the circumferential surface of the transfer sheet discharging roller 55A so that transfer sheet P can be conveyed in the rotating direction of the transfer sheet discharging roller 55A.

Consequently, transfer sheet P is brought into pressure contact with the circumferential surface of the transfer sheet discharging roller 55A, and conveyed upward by its frictional force. Then, transfer sheet P is discharged face-up onto the front surface (the right side surface in FIG. 8) of the bin 53A, and received by a recording sheet receiver 531A.

When a predetermined period of time $T_1$ has passed after the trailing edge of the first transfer sheet P was detected by photo-sensor PS (in this period of time, conveyance of the first transfer sheet P is completed by the transfer sheet discharging roller 55A), the solenoid is turned off and the guide plate 56A is returned to the position illustrated by a broken line.

The leading edge of the second transfer sheet P on which the image of the first page is recorded, is detected by photo-sensor PS, wherein the interval between the trailing edge of the first sheet and the leading edge of the second sheet is maintained to be $\Delta$ (the time interval is $\Delta t$). Then, the guide plate 56B is raised, and in the same manner mentioned above, transfer sheet P is discharged into the bin 53B. When a predetermined period of time $T_2$ has passed after the trailing edge of the second transfer sheet P was detected, the guide plate 56B is returned in the same manner as described before.

The aforesaid predetermined period of time T ($T_1 \cdot T_2$ . . . ) is determined by t and t'. ($T=t+t'$) In this case, t is the period of time for conveyance of transfer sheet P from the time when photo-sensor PS detects the leading edge of transfer sheet P to the time when photo-sensor PS detects the trailing edge, so that t differs according to the length of transfer sheet P, and t' is the period of time from the time when the trailing edge of transfer sheet P is detected to the time when transfer sheet P is conveyed and discharged, wherein t' is determined according to the bin position.

After all transfer sheets P on which the image of the first page was recorded, have been successively discharged into the bins, transfer sheets P on which the image of the second page was recorded, are continuously discharged. As a result, all transfer sheets P corresponding to a predetermined number of volumes are discharged and sorted face-up.

On the other hand, when transfer sheet discharging mode (B) is selected in which transfer sheets P are discharged face-down, operations are performed in the following manner: concurrently when the conveyance belt 51 is started, the transfer sheet discharging rollers 55A to 55F are rotated counterclockwise; and the rack 58 is slid to the left since a drive motor (not shown) is turned on, so that the bins 53A to 53F are rotated to the positions illustrated by a one-dotted chain line.

In the same manner as transfer sheet discharging mode (A), operations are performed in the following manner: transfer sheet P on which the image of the first page is recorded, is conveyed by the conveyance belt 51; the conveyed transfer sheet is detected by photosensor PS; the guide plate 57A is raised by the action of the solenoid to the position illustrated by a one-dotted chain line; and transfer sheet P is moved in the direction of the guide plate 57A along the circumferential surface of the transfer sheet discharging roller 55A which is rotated counterclockwise.

Consequently, transfer sheet P is brought into pressure contact with the circumferential surface of the transfer sheet discharging roller 55A, and conveyed upward by its frictional force. Then, transfer sheet P is discharged face-down onto the back surface (the left side surface in FIG. 8) of the bin 53A.

The second transfer sheet P and after that on which the image of the first page is recorded, and transfer sheets P on which the image of the second page and images after that are recorded, are discharged onto the back surface of each bin in the same manner as that of transfer sheet discharging mode (A).

As a result, transfer sheets P are discharged face-down, and they are sorted in such a manner that the order of pages is the same as that of the documents.

In the case where transfer sheet discharging mode (A) is performed according to the outside communication system (not shown) while image processing is conducted according to the image forming process shown in FIG. 8, it is possible to set the transfer sheet discharging mode (B) automatically.

According to the present invention, a very useful image forming apparatus can be provided which can selectively discharge transfer sheets onto a sorter face-down or face-up by a very simple mechanism, wherein the transfer sheets are sorted in such a manner that the order of the transfer sheets is the same as that of the document pages.

Figure 10:
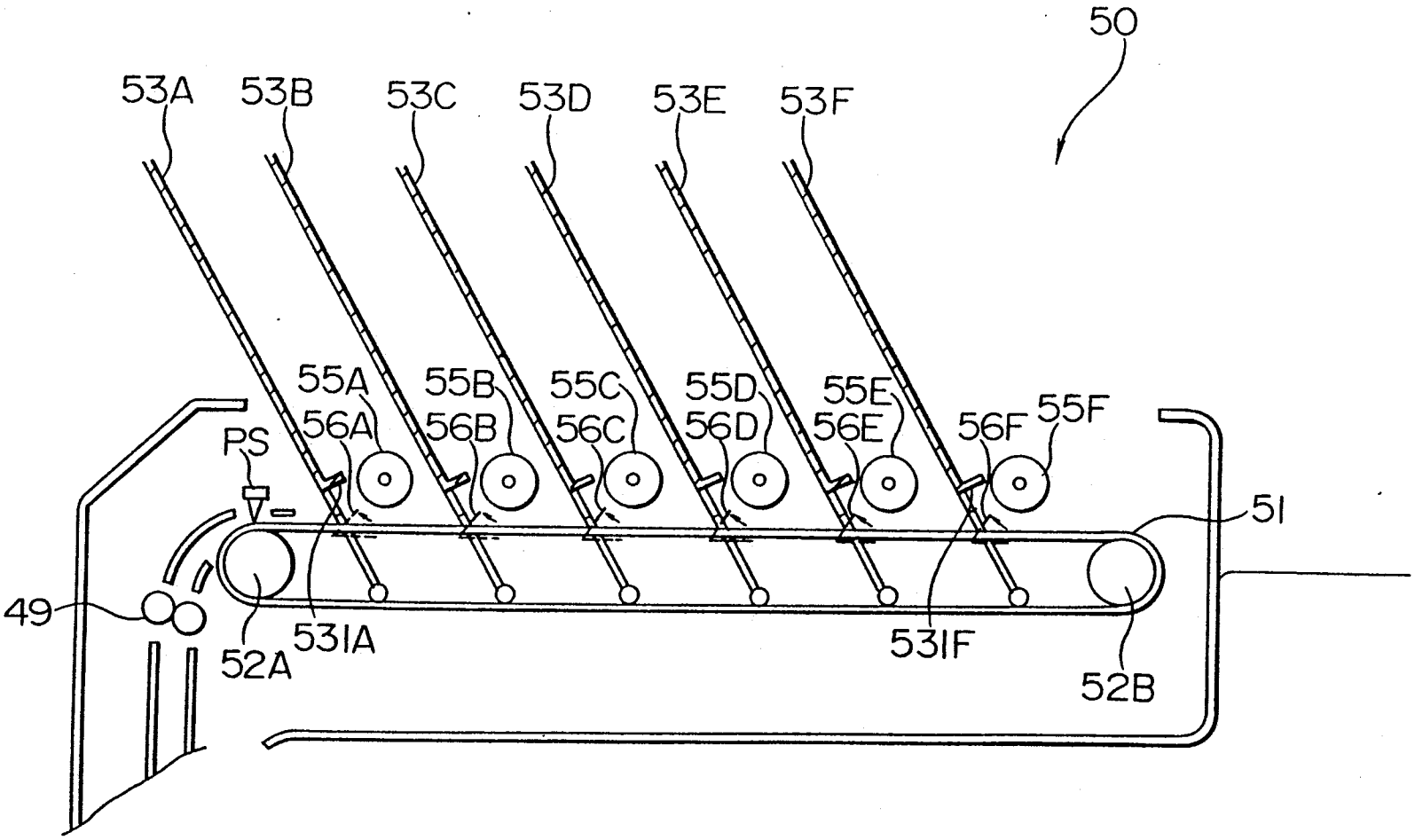
FIG. 10 is a front view showing the outline of the sorter of the invention.
Figure 11:
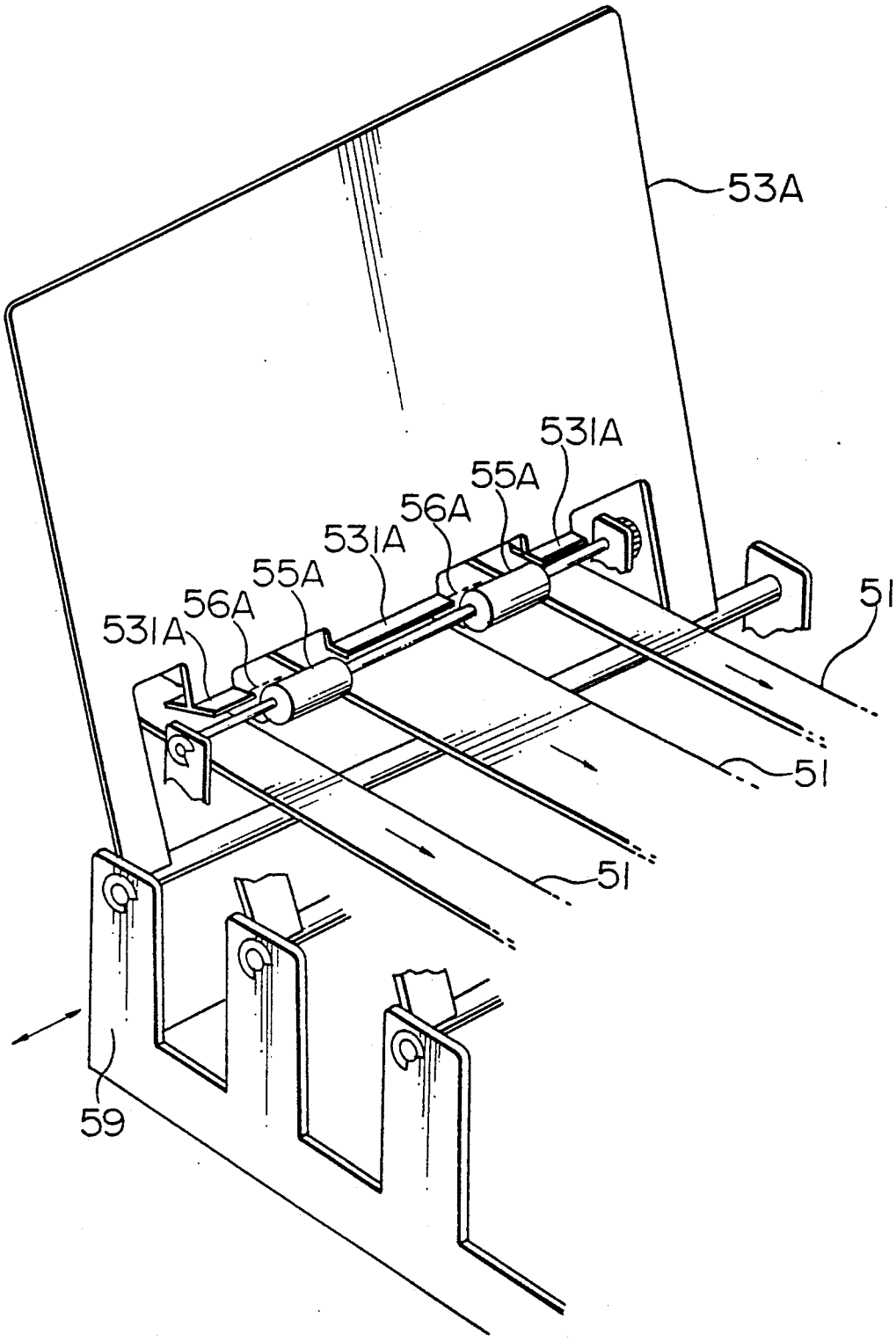
FIG. 11 is a perspective view showing the outline of the sorter of the invention.
Figure 12:
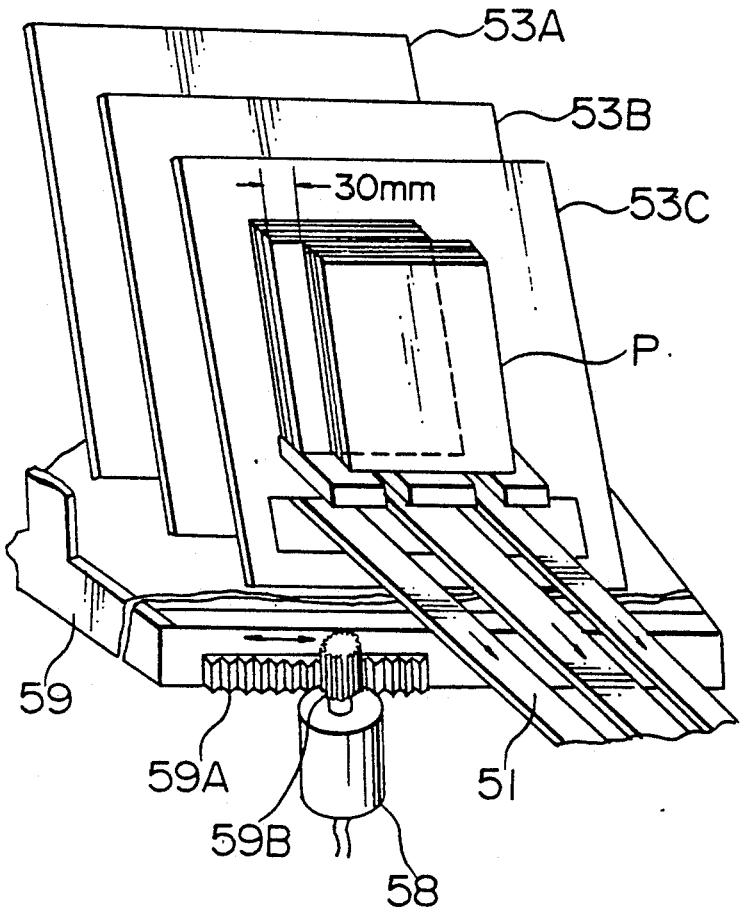
FIG. 12 is a perspective view showing a stacking condition of transfer sheets when a sorter movement device is applied.

Another example of the present invention is shown in FIG. 10 to FIG. 12.

FIG. 10 shows the detail of structure of the sorter 50 illustrated in FIG. 7. Numeral 51 is a conveyance belt which is wound around the drive roller 52B and the idle roller 52A. The conveyance belt 51 is always circulated clockwise by the drive roller 52B which is driven clockwise.

For example, as shown in FIG. 11, the conveyance belt 51 is composed of 3 belts, the width of which is limited, and disposed in parallel at predetermined intervals.

Numerals 53A to 53F are bins in which transfer sheets P are accommodated. The lower edge portion of each bin is cut out so that the conveyance belt 51 can pass through the bin. Both outsides of each bin are fixed to the frame 59 of the sorter 50.

Numerals 55A to 55F are transfer sheet discharging rollers. Numerals 56A to 56F are rotatable guide plates which can be rotated from the position shown by a broken line to the position shown by a solid line.

FIG. 11 is a view showing the relation of the conveyance belt 51 (which advances in the direction of an arrow), transfer sheet discharging roller 55A, and guide plate 56A with regard to the bin 53A.

Next, the transfer sheet discharging operation will be explained which is conducted on the sorter 50. In this case, only different points from the aforementioned example will be explained here.

When an operation panel (not shown) is operated so that transfer sheets P are discharged face-up, the conveyance belt 51 is started, and concurrently the transfer sheet discharging rollers 55A to 55F are rotated clockwise all at once.

In the manner mentioned above, a sorting operation is conducted, wherein the maximum number of volumes to be sorted is the same as the maximum number of bins of the sorters 50. Of course, in the case where the number of volumes is smaller than the maximum number of the bins, the number of repeated operations is also small.

In the case where an optional number of volumes which is larger than the aforementioned maximum number of bins, is required, operations are conducted in the following manner: first, volumes, the number of which is the same as the maximum bin number, are sorted in the manner described before; only the sorter 50 is horizontally moved by a predetermined distance (for example, 30 mm) in the direction perpendicular to the transfer sheet conveyance direction as shown by the arrow mark in FIGS. 11 and 12 when the rack 59A provided to the frame 59 is meshed with the pinion 59B which is directly connected with the motor 58 provided to the image forming apparatus body; after the movement, the sorter 50 is set at the position; and the document images are formed again in the order of pages, wherein the transfer sheets are discharged face-up into the bins and the number of volumes is the same as that of the required volumes.

At this time, since the entire sorter 50 is shifted by 30 mm, each volume is also shifted by 30 mm as shown in the perspective view of FIG. 12. Therefore, there is no possibility that the volumes are mixed with each other in the sorting process.

In the case where the number of volumes is not less than twice as much as the maximum number of bins, the third repetition is performed. At this time, the sorter 50 is further shifted by a predetermined distance (for example, 30 mm), and the aforementioned sorting operation is repeated. In this case, the third additional volumes are shifted by 30 mm with respect to the second additional volumes, so that the volumes are not mixed with each other in the sorting operation.

According to the present invention, the sorter is provided at the same level as the platen unit, and the transfer sheets are stacked face-up on the sorter, so that the operator can operate the apparatus while he is manned in the front of the apparatus. Therefore, the operator can operate while he is observing the recorded images. In the aforementioned manner, the present invention can provide an image forming apparatus of high operability.

Further, the sorter can be shifted by a predetermined distance in the direction perpendicular to that of transfer sheet conveyance. Accordingly, even when the number of bins is small, a large number of volumes can be positively sorted.

With reference to an example shown in FIGS. 13 to 20, the present invention will be further explained as follows.

Figure 13:
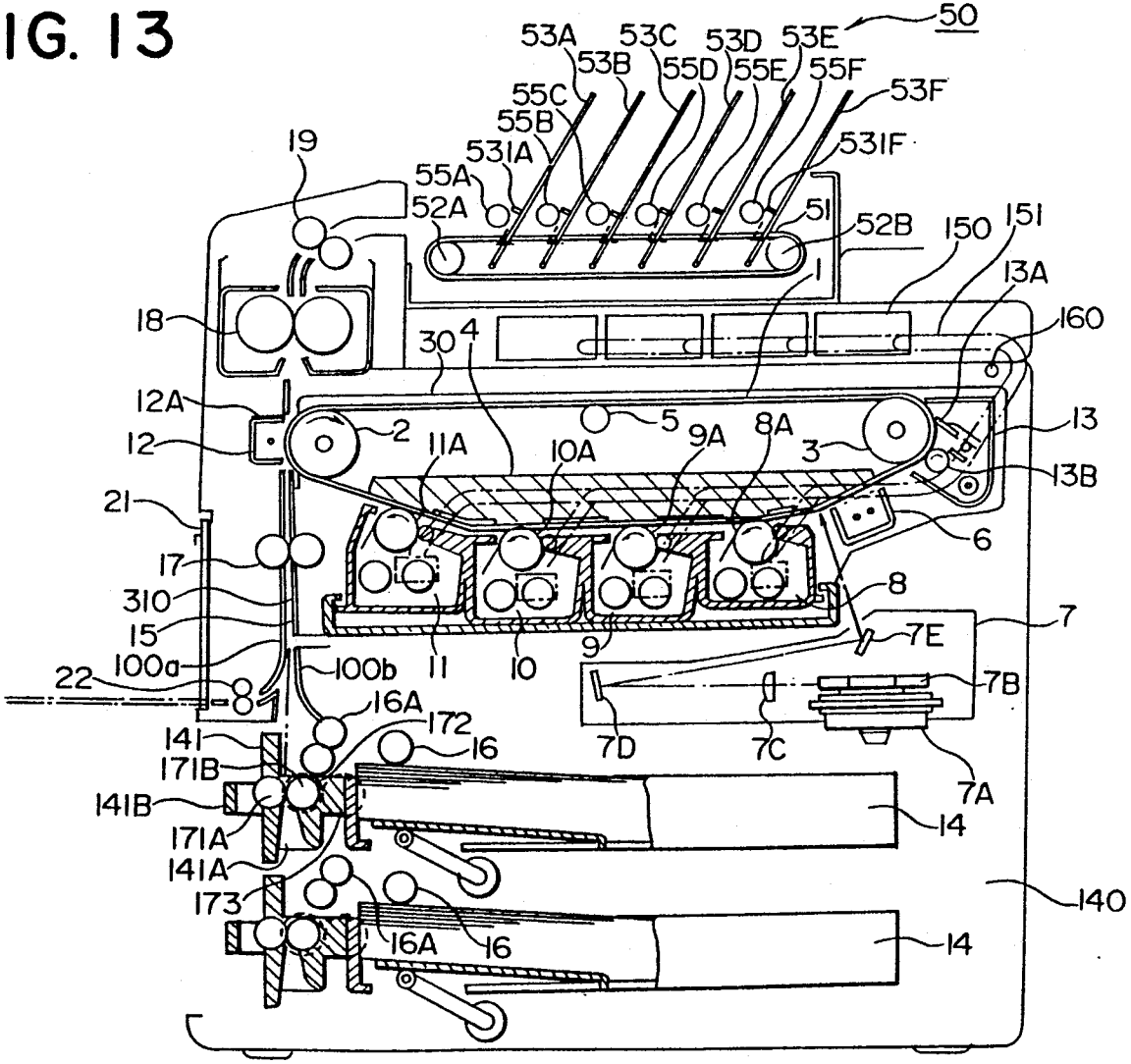
FIG. 13 is a sectional view of the image forming apparatus of the present invention.

In FIG. 13, numeral 1 is a flexible photoreceptor belt which is a belt-shaped image forming body. The photoreceptor belt 1 is provided between a drive roller 2 and an idle roller 3, and rotated clockwise.

Numeral 4 is a guide member fixed to the apparatus body so that the guide member 4 is internally brought into contact with the lower portion of the photoreceptor belt 1. Numeral 5 is a tension roller to give a tension to the photoreceptor belt 1 in order to make the photoreceptor belt 1 come into contact with the guide member 4. The guide member 4 and tension roller 5 make it possible to form a stable image forming surface on the photoreceptor belt 1.

Numeral 6 is a scorotron charger which is a charging means. Numeral 7 is a laser writing system unit which is an image exposure means. Not only the optical type of laser writing system unit 7 illustrated in the drawing but also an optical system in which a light emitting section and a convergent light transmitter are unified, is utilized.

Numerals 8, 9, 10 and 11 are a plurality of developing units which contain developers, for example, of yellow, magenta, cyan and black. The developing units 8 to 11 are disposed so that they face the photoreceptor belt 1 with which the guide member 4 is internally contacted. These developing units 8 to 11 are provided with developing sleeves 8A, 9A, 10A, 11A, and a predetermined gap is formed between the developing sleeve and the photoreceptor belt 1, so that a latent image on the photoreceptor 1 is developed into a visual image by the non-contact developing method.

Numeral 12 indicates a transfer unit. Numeral 12A is a discharging bar. Numeral 13 indicates a cleaning unit. A blade 13A of the cleaning unit 13 and a toner conveyance roller 13B are kept away from the surface of the photoreceptor belt 1 during image formation, and pressed onto the surface of the photosensitive belt 1 as shown in the drawing only when the surface is cleaned after image transfer.

The color image forming process of the aforesaid color image forming apparatus, which is a printer, is carried out as follows.

Figure 14:
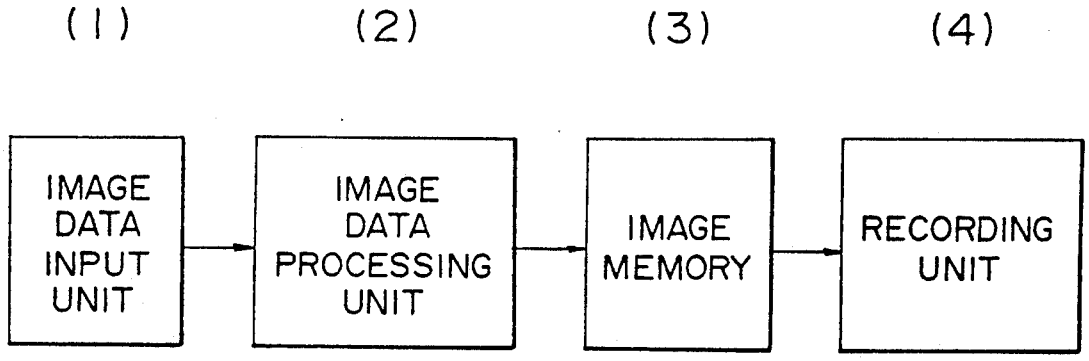
FIG. 14 is a block diagram showing an image formation system.

First, multi-color image formation according to this example is carried out by an image forming system shown in FIG. 14. Data obtained by a color image data input unit (1) when an original image is scanned by image pick-up elements, is processed by an image data processing unit (2) so as to create image data, and the image data is stored temporarily in an image memory (3). The image data is retrieved for recording and inputted into a recording unit (4), for example, the color image forming apparatus shown in the example in FIG. 13. When a color signal outputted from an image reader which is different from a printer, is inputted into the laser writing system 7, a laser beam generated by a semiconductor laser (not shown in the drawing) is rotationally scanned by a polygonal mirror 7B which is rotated by a drive motor 7A in the laser writing system unit 7, and the optical path of the laser beam is curved by mirrors 7D, 7E and 7F through $f\theta$ lens 7C. Then, the laser beam is irradiated onto the peripheral surface of the photosensitive belt 1 which is electrically charged beforehand by the charging unit 6 which is a charging means so as to form a bright line.

When scanning starts, the beam is detected by an index sensor, the beam by the first color signal starts modulation, and the modulated beam scans on the peripheral surface of the photosensitive belt 1. Therefore, a latent image corresponding to the first color is formed on the peripheral surface of the photosensitive belt 1 by the primary scanning of the laser beam and by the auxiliary scanning by the movement of the photosensitive belt 1. This latent image is developed by the developing unit 8 of the developing means containing yellow (Y) toner and a toner image is formed on the photoreceptor belt surface. The toner image formed on the photoreceptor belt surface passes under the blade **13*a* of the cleaning unit 13 which is separated away from the peripheral surface of the photosensitive belt 1**, and then the process enters the next copy cycle.

The photoreceptor belt 1 is charged by the charging 6 once again, and the second color signal outputted from the signal processing unit is inputted into the laser writing system 7. Then, data is written on the photoreceptor belt surface in the same manner as the aforementioned case of the first color signal so as to form a latent image. The latent image is developed by the developing unit 9 containing magenta (M) toner as the second color. This magenta (M) toner image is formed on the aforementioned yellow (Y) toner image which has already been formed, wherein the magenta toner image is accurately superimposed on the yellow toner image being synchronized by a registration signal. In the same manner, a cyan (C) toner image is formed by the developing unit 10 containing cyan (C) toner. Further, a black toner image is formed by the developing unit 11 containing black toner.

A DC or AC bias voltage is impressed upon each sleeve of the developing units 8, 9, 10 and 11, and then jumping development is performed by a 2-component developer which is a developing means, and non-contact development is performed on the photoreceptor belt 1, the base of which is grounded. In this case, non-contact development using a 1-component developer may be performed.

At the transfer unit, color toner images formed on the peripheral surface of the photoreceptor belt 1 are transferred onto a transfer sheet.

Transfer sheets are conveyed out from one of the upper and lower transfer sheet accommodating cassette (referred to as a cassette, hereinafter) provided in the cassette accommodation chamber 140 (provided integrally with or separately from the apparatus body), by the rotating motion of the transfer sheet feed roller 16 and the separation roller 16A.

Both of the cassettes are provided with a passing guide 141 having a slit-shaped guide hole 141A, wherein the passing guide 141 is formed on the side edge portion of the apparatus which corresponds to the front side of the apparatus (in FIG. 13, it is the left side surface of the apparatus). A transfer sheet which has been conveyed out from the lower cassette 14, passes through the guide hole 141A of the passing guide 141, so that the transfer sheet is guided to the transfer sheet passage 15 as shown by a two-dotted chain line. For example, a transfer sheet is conveyed out by the transfer sheet feed roller 16 which is driven by a motor not shown. Then, the transfer sheet is conveyed between the feed rollers 171A and 171B which are driven by the feed roller drive gear 173 through the feed roller gear 172. After that, the transfer sheet passes through the transfer sheet passage 15 including the conveyance guides **100*a*, 100*b*, the cartridge side plate 310 and so forth, and is conveyed to the transfer unit 12**.

The cassette 14 is horizontally inserted into the cassette accommodation chamber 140 when an operator holds the handle 141B and pushes the cassette 14. The cassette 14 is slid along a guide member (not shown in the drawing) provided in the cassette accommodation chamber 140, and engaged in a predetermined setting position.

When the cassette 14 is provided in the apparatus body, the transfer sheet feeding device provided in the cassette accommodation chamber 140 is operated so that the transfer sheet can be conveyed in the aforementioned manner.

Figure 15:
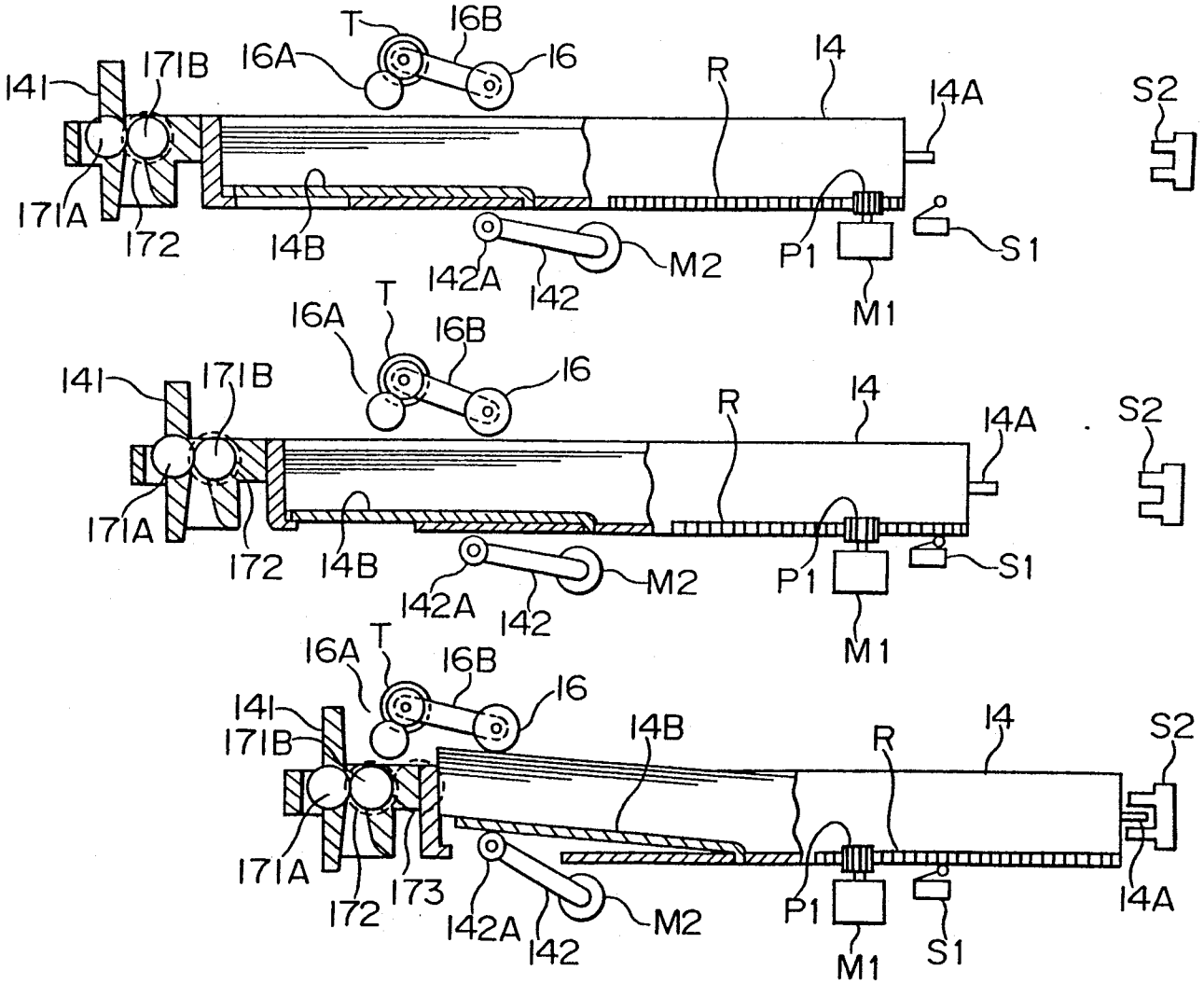
FIG. 15 is a schematic illustration showing the progress of mounting a transfer sheet cassette on the image forming apparatus.

FIG. 15 shows the circumstances in which the transfer sheet feeding device is operated while the cassette 14 is inserted into the chamber.

As shown in FIG. 15, the cassette 14 is integrally provided with the feed roller 171A, 171B and the feed roller gear 172.

A plate-shaped projection 14A is provided to the side edge portion of the cassette 14 opposite to the side edge portion in which the passing guide 141 is mounted. Further, rack R is provided on one side of the cassette.

On the other hand, in the cassette accommodation chamber 140, there are provided motors M1, M2, micro-switch S1, and photoelectric switch $2 including photo-coupler.

Pinion P1 is mounted on the rotating shaft of motor M1, and when the cassette 14 is inserted into a predetermined position of the cassette accommodation chamber 140, rack R of the cassette 14 is meshed with pinion P1.

A pushup lever 142 is mounted on a horizontal rotating shaft of motor M2, and a roller 142A is mounted on the tip of the pushup lever 142. In the case where the cassette 14 has not reached the setting position, motor M2 is rotated counterclockwise, so that the roller 142A is withdrawn to under the inserting passage of the cassette 14.

On the other hand, the transfer sheet feeding roller 16 is mounted on the tip of a transfer sheet feeding lever 16B which is rotated around the axial center of the separation roller 16A. The transfer sheet feeding roller 16 is set on a stopping board by the action of a resilient member (not shown) which pushes the transfer sheet feeding lever 16B clockwise, so that the transfer sheet feeding roller 16 is held above the inserting passage of the cassette 14.

When the cassette 14 is inserted into a predetermined position in the cassette accommodation chamber 140, rack R of the cassette 14 meshes with pinion P1 mounted on the rotating shaft of motor M1 as shown in FIG. 15(A).

When the cassette 14 is further inserted into the chamber, micro-switch S1 is changed over from OFF to ON since it is pushed by the bottom of the cassette 14, so that motor M1 is operated and pinion P1 is driven. Therefore, the inserting operation of the cassette 14 is automatically continued.

When the cassette 14 reaches the setting position, photoelectric switch $2 is changed over from OFF to ON by the projection 14A provided on the side of the cassette 14. Accordingly, motor M1 is stopped, and the cassette 14 is set in the position. At the same time, the feeding roller gear 172 provided integrally with the cassette 14, and the feeding roller drive gear 173 provided in the cassette accommodation chamber 140 are meshed so that the drive force generated by a drive motor (not shown) can be transmitted from one gear to the other.

Concurrently when photo-electric switch $2 is changed over from OFF to ON, motor M2 is rotated so that the pushup lever 142 is rotated clockwise. Accordingly, the bottom plate 14B is pushed upward by the roller 142A.

Transfer sheets are stacked on the bottom plate 14B. When the bottom plate 14B is pushed upward in the aforementioned manner, the transfer sheet feeding roller 16 is pushed upward by the uppermost transfer sheet stacked on the bottom plate. When the transfer sheet feeding roller 16 is lifted up at a predetermined level, torque limiter T mounted on the bearing portion of the transfer sheet feeding lever 16B is operated, so that motor M2 is returned to OFF. Consequently, as shown in FIG. 15 (C) , the transfer sheet is brought into contact with the transfer sheet feeding roller 16 with a predetermined pressure, and this contacting condition is maintained so that transfer sheets can be fed from the cassette 14.

Under the condition shown in FIG. 15 (C), the transfer sheet feeding roller 16 and the separation roller 16A are rotated so as to feed the transfer sheets stacked on the bottom plate 14B. As the number of the transfer sheets stacked on the bottom plate 14B is reduced, the transfer sheet feeding roller 16 goes downward, so that the transfer sheet feeding lever 16B is returned clockwise. As a result, torque limiter T returns to its initial condition, and motor M2 is started again. Due to the foregoing, the transfer sheets on the bottom plate **14*b* are raised again so that the transfer sheet feeding condition of the cassette 14** can be continuously maintained. The aforementioned operation is repeatedly conducted while the transfer sheets are fed from the cassette.

In the case where the cassette 14 is taken out from the cassette accommodation chamber 140, the following operations are carried out: when a cassette release button provided on the front side of the apparatus is pressed, motors M1 and M2 are changed over to a mode of reverse rotation and turned on; due to the foregoing, the pushup lever 142 is rotated counterclockwise, so that the roller 142A is withdrawn to under the cassette 14; and at the same time pinion P1 is reversed, so that the cassette 14 is pushed out to a predetermined position in the cassette accommodation chamber 140.

Therefore, when the operator pulls the handle 141B a little, the cassette 14 can be easily taken out from the apparatus body.

In the case of an apparatus in which a slidable tray to support the cassette 14 is provided in the cassette accommodation chamber 140, rack R may be formed on the side of the tray so that the cassette 14 can be attached to and detached from the apparatus body when the tray is moved.

As a method to bring the transfer sheet into pressure contact with the transfer sheet feeding roller 16, not only the method shown in this example by which the bottom plate 14B is pushed up, but also the method by which the entire cassette 14 is pushed up and inclined, can be adopted.

Each transfer sheet conveyed out from the cassette 14 is directly conveyed to the transfer sheet passage 15, or conveyed to the transfer sheet passage through the passing guide 141. Then, the transfer sheet is supplied to the transfer unit 12 through the timing roller 17 synchronously with the image formation performed on the photoreceptor belt 1.

The transfer sheet onto which an image has been transferred by the transfer unit 12, is discharged. Then, the transfer sheet is positively separated from the photoreceptor belt 1 which is sharply curved along the drive roller 2, wherein the radius of curvature is small. After that, the transfer sheet is conveyed upward, and the image on the transfer sheet is fixed by the fixing roller 18. Then, the transfer sheet is discharged onto the sorter 50 through the transfer sheet discharging roller 19, wherein the order of the discharged transfer sheets is the same as that of the pages.

Figure 16:
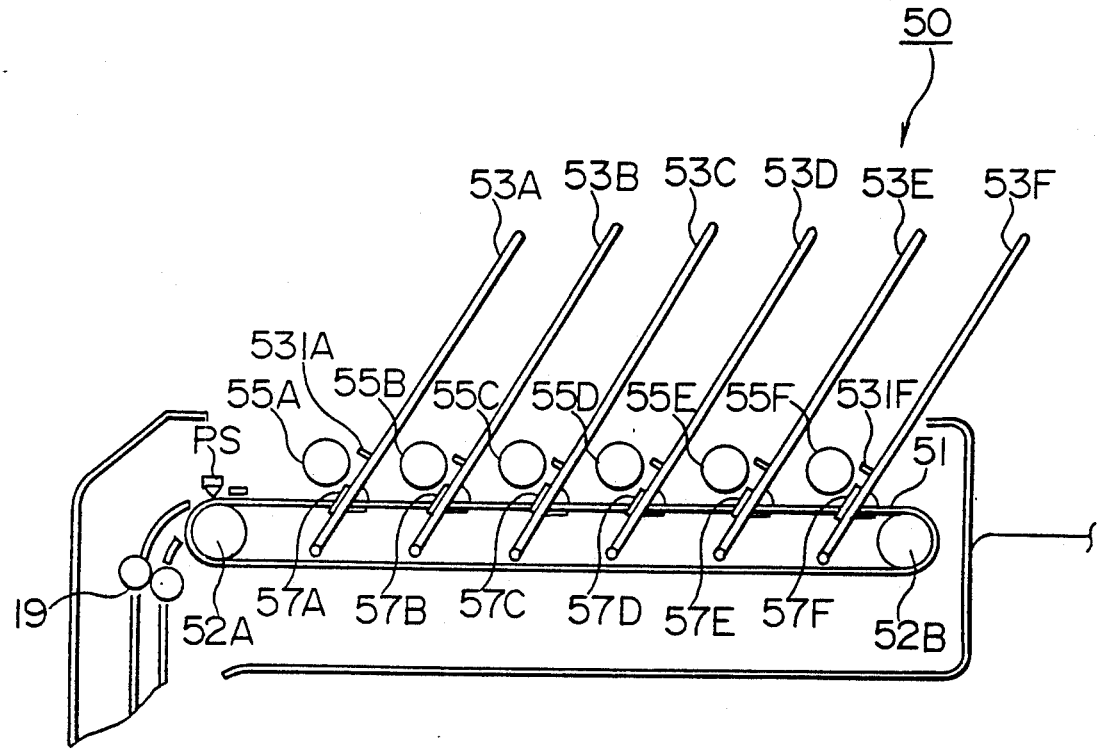
FIG. 16 is a sectional view of a sorter.

FIG. 16 shows the detail of the structure of the sorter 50. Numeral 51 is a conveyance belt wound around the drive roller 52B and the idle roller 52A, and the conveyance belt 51 is always rotated clockwise by the drive roller 52B.

Figure 17:
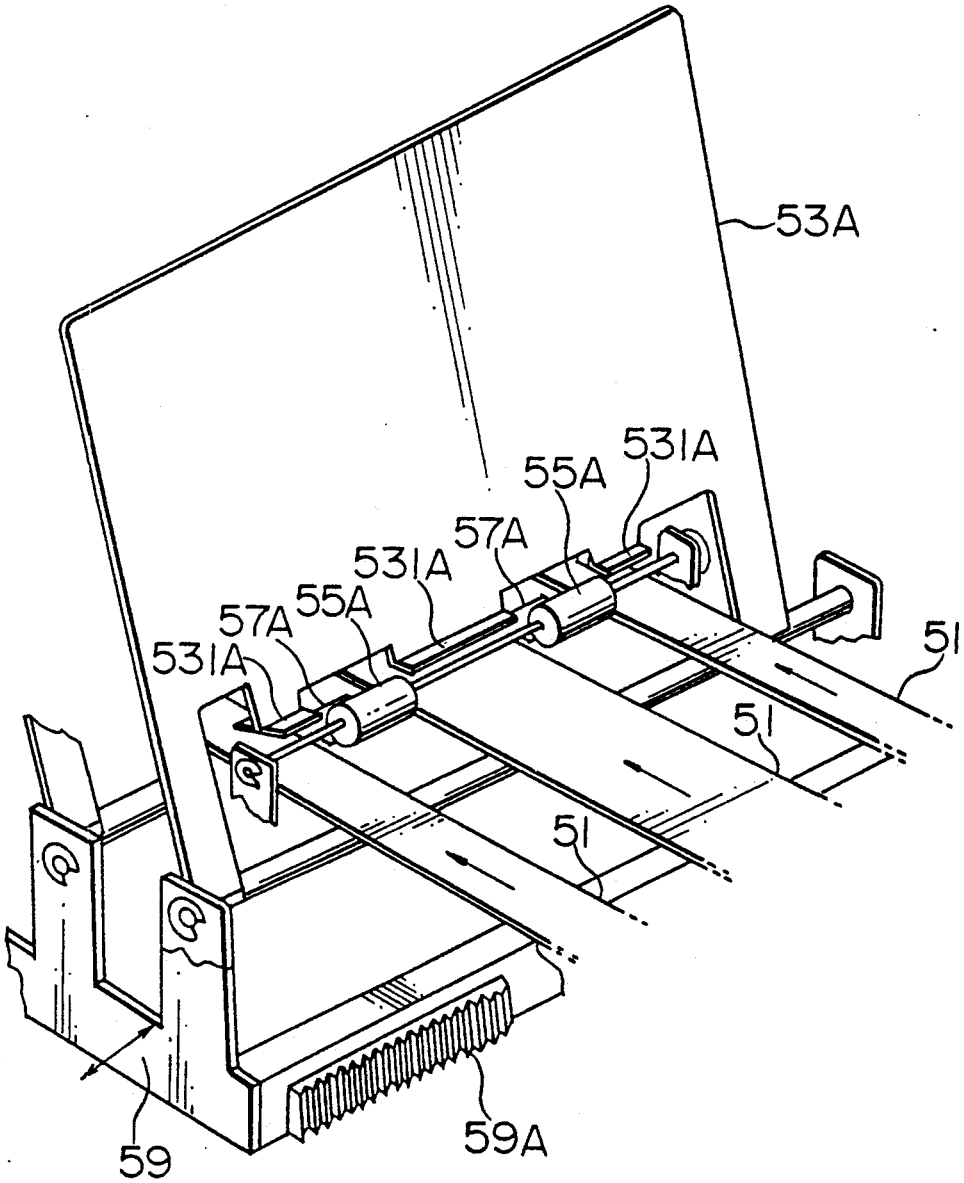
FIG. 17 is a perspective view showing a portion of a sorter.

As shown in the perspective view of FIG. 17, the conveyance belt 51 is composed of, for example, 3 belts disposed in parallel with each other at preset intervals, wherein the widths of 3 belts are limited.

Numerals 53A to 53F are bins in which transfer sheets P are accommodated. The lower portion of each bin is cut out so that the conveyance belt 51 can pass through the bin. Both sides of the bin are fixed to the frame 59 of the sorter 50.

Numerals 55A to 55F are transfer sheet discharging rollers. Numerals 57A to 57F are rotatable guide plates which can be rotated from the position illustrated by a broken line to the position illustrated by a solid line.

FIG. 17 is a view showing the relation of the conveyance belt 51 (which advances in the direction of an arrow), transfer sheet discharging roller 55A, and guide plate 56A with regard to the bin 53A.

Next, the transfer sheet discharging operation will be explained which is conducted on the sorter 50.

When an operation panel (not shown) is operated so that transfer sheets P are discharged face-down, the conveyance belt 51 is started, and concurrently the transfer sheet discharging rollers 55A to 55F are rotated counterclockwise in FIG. 16 all at once.

When the first transfer sheet P, on which the image of the first page is recorded, is conveyed by the conveyance belt 51 and its leading edge is detected by photo-sensor PS, the guide plate 57A is raised to the position illustrated by a solid line due to the action of a solenoid. Accordingly, the advancing direction of transfer sheet P is changed to the direction of the guide plate 57A, and transfer sheet P is guided along the circumferential surface of the transfer sheet discharging roller 55A.

Consequently, transfer sheet P is brought into pressure contact with the circumferential surface of the transfer sheet discharging roller 55A, and conveyed upward by its frictional force. Then, transfer sheet P is discharged face-down onto the front surface of the bin 53A, and received by a transfer sheet receiver 531A.

When a predetermined period of time $T_1$ has passed after the trailing edge of the first transfer sheet P was detected by photo-sensor PS (in this period of time, conveyance of the first transfer sheet P is completed by the transfer sheet discharging roller 55A), the solenoid is turned off and the guide plate 57A is returned to the position illustrated by a broken line.

The leading edge of the second transfer sheet P on which the image of the first page is recorded, is detected by photo-sensor PS, wherein the interval between the trailing edge of the first sheet and the leading edge of the second sheet is maintained to be l (the time interval is $\Delta t$). Then, the guide plate 57B is raised, and in the same manner mentioned above, transfer sheet P is discharged into the bin 53B. When a predetermined period of time $T_2$ has passed after the trailing edge of the second transfer sheet P was detected, the guide plate 57B is returned in the same manner as described before.

The aforesaid predetermined period of time T ($T_1 \cdot T_2 \ldots$) is determined by t and t'. ($T=t+t'$) In this case, t is the period of time for conveyance of transfer sheet P from the time when photo-sensor PS detects the leading edge of transfer sheet P to the time when photo-sensor PS detects the trailing edge, so that t differs according to the length of transfer sheet P, and t' is the period of time from the time when the trailing edge of transfer sheet P is detected to the time when transfer sheet P is conveyed and discharged, wherein t' is determined according to the bin position.

After all transfer sheets P on which the image of the first page was recorded, have been successively discharged into the bins, transfer sheets P on which the image of the second page was recorded, are continuously discharged. As a result, all transfer sheets P corresponding to a predetermined number of volumes are discharged and sorted face-down.

As described above, the maximum number of sorted volumes is the same as the number of bins provided to the sorter 50. When the number of required volumes is smaller than the maximum number of bins, the operations of the required number are repeatedly conducted to obtain volumes of the required number.

In the case where an optional number of volumes which is larger than the aforementioned maximum bin number, is required, operations are conducted in the following manner: first, volumes, the number of which is the same as the maximum bin number, are sorted in the manner described before; only the sorter 50 is horizontally moved by a predetermined distance (for example, 30 mm) in the direction perpendicular to the transfer sheet conveyance direction as shown by the arrow mark in FIGS. 17 and 18 when the rack 59A provided to the frame 59 is meshed with the pinion 59B which is directly connected with the motor 58 provided to the image forming apparatus body; after the movement, the sorter 50 is set at the position; and the document images are formed again in the order of pages, wherein the transfer sheets are discharged face-up into the bins and the number of volumes is the same as that of the required volumes.

Figure 18:
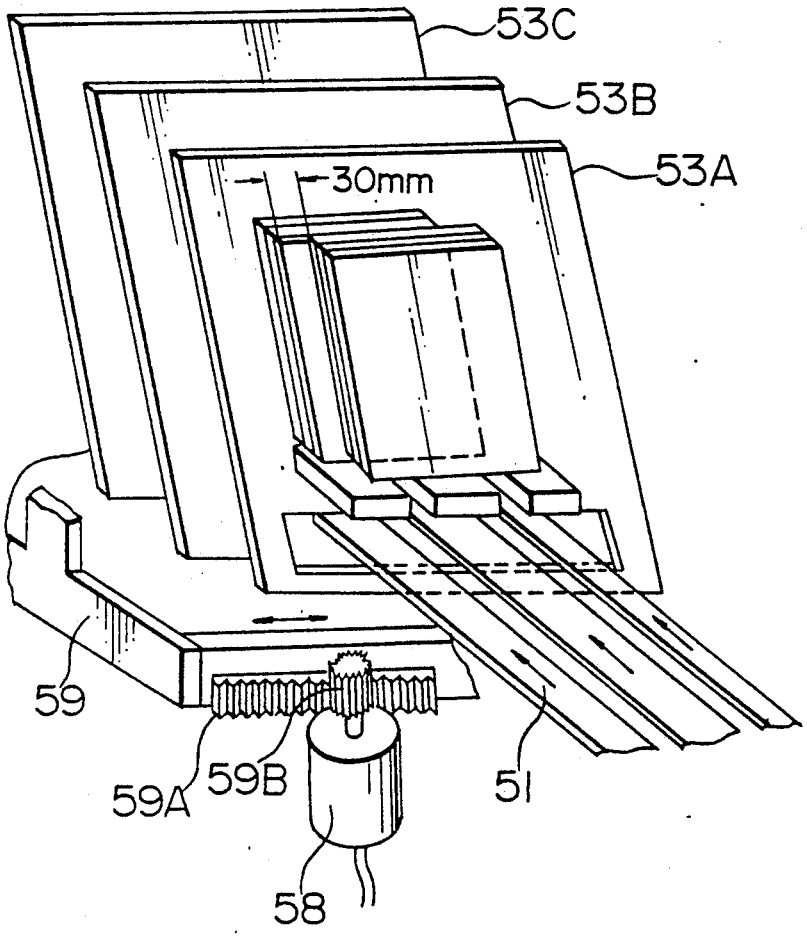
FIG. 18 is a perspective view showing circumstances in which transfer sheets are shifted at each sorted group.

At this time, since the entire sorter 50 is shifted by 30 mm, each volume is also shifted by 30 mm as shown in the perspective view of FIG. 18. Therefore, there is no possibility that the volumes are mixed with each other in the sorting process.

In the case where the number of volumes is not less than twice as much as the maximum number of bins, the third repetition is performed. At this time, the sorter 50 is further shifted by a predetermined distance (for example, 30 mm), and the aforementioned sorting operation is repeated. In this case, the third additional volumes are shifted by 30 mm with respect to the second additional volumes, so that the volumes are not mixed with each other in the sorting operation.

On the other hand, after transfer, the photoreceptor belt 1 is further rotated, and residual toner is removed from the photoreceptor belt 1 by the cleaning unit 13 in which the blade 13A and the toner conveyance roller 13*b* are brought into pressure contact with the photoreceptor belt 1. After the cleaning operation has been completed, the blade 13A is separated from the photoreceptor belt 1. A little after that, the toner conveyance roller 13B smooths the toner accumulated on the tip of the blade 13A, and then the toner conveyance roller 13*b* is separated from the surface of the photoreceptor belts 1. Then, the apparatus enters a new image forming process.

On the other hand, the photoreceptor belt 1, developing units, charger 6, cleaning unit 13, transfer sheet feeding passage 15, and a member which is opposed to the timing roller 17 are incorporated into the cartridge 30. Accordingly, these units are integrally attached to and detached from the apparatus.

When the cartridge 30 is provided into the apparatus body, the toner conveyance pipe 151 of the toner hopper 150 is automatically connected with a developing unit which corresponds to the toner conveyance pipe, so that toner can be supplied to the developing unit.

The aforesaid apparatus is provided with not only the automatic transfer sheet feeding means but also a manual transfer sheet feeding means. In the case of a manual transfer sheet feeding operation, the manual transfer sheet guide plate 21 is horizontally opened, and inserted transfer sheets are conveyed to the transfer sheet passage 15 through the manual feed guide roller 22 one by one.

The sorter 50 is provided to the apparatus body. However, it can be detached from the apparatus body when necessary. In the case where the sorter mounted on the apparatus is not used as a sorter, transfer sheets may be stacked on the first bin, or the sorter may be removed from the apparatus and the transfer sheets may be stacked on a flat portion of the apparatus.

Figure 19:
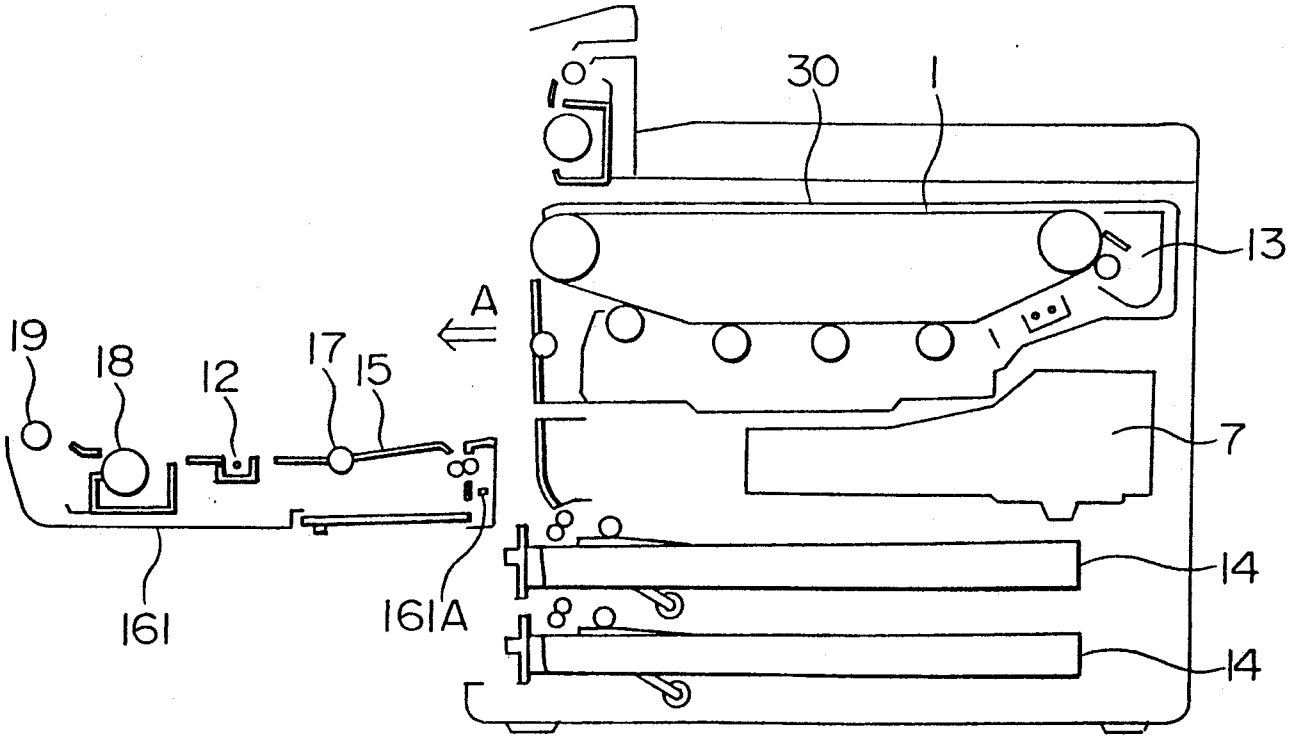
FIG. 19 is a schematic illustration showing an example of the structure of the image forming apparatus.

FIG. 19 shows an example of the first structure in which the left side surface of the apparatus is composed of the side cover 161, wherein the side cover 161 is rotated around the shaft 161A so that it can be opened. When the side cover 161 is opened as shown in FIG. 19, all the transfer sheet passage ranging from the transfer sheet passage 15 to the transfer sheet discharging roller 19 can be opened. Therefore, the cartridge 30 can be easily attached to and detached from the apparatus in the direction indicated by an arrow mark A.

Figure 20:
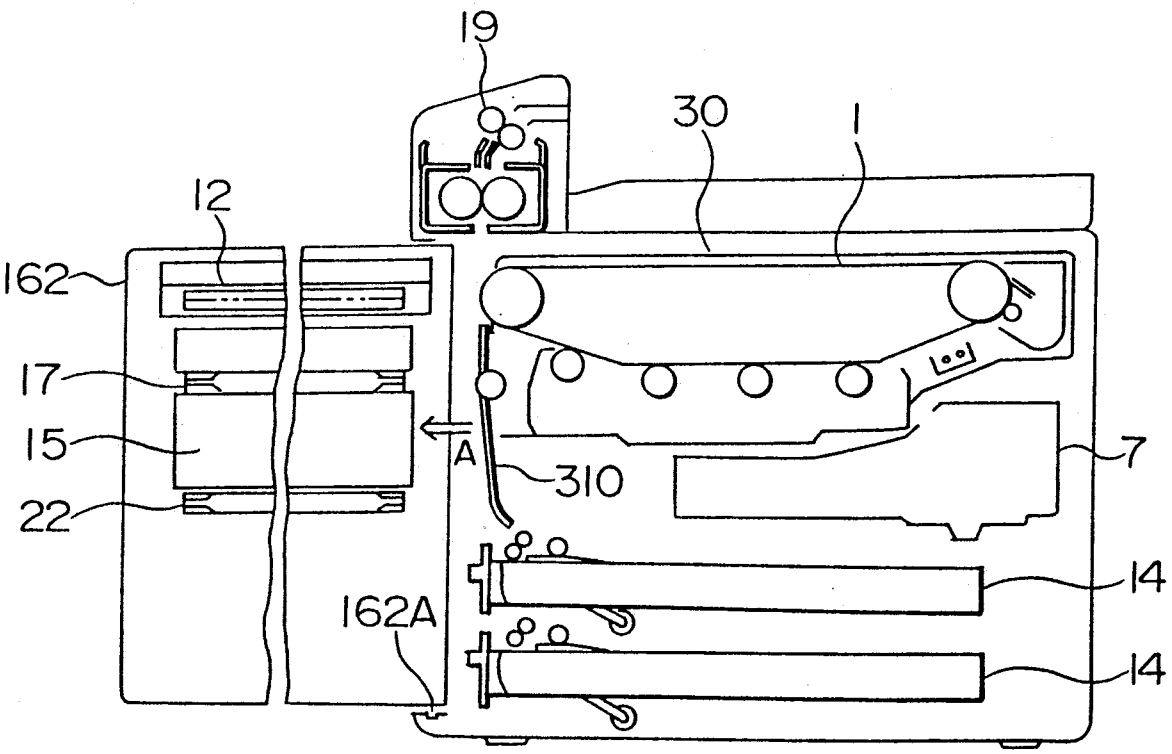
FIG. 20 is a schematic illustration showing an example of structure of the image forming apparatus.

FIG. 20 shows an example of the second structure in which the left side surface of the apparatus is composed of the side cover 162 which is horizontally opened with the fulcrum of the shaft 162A. The side cover 162 is provided with the transfer unit 12, manual feed guide plate 21, manual feed guide roller 22, and members which are opposed to the transfer sheet passage 15 and the timing roller 17.

Consequently, when the side cover 162 is opened, the cartridge 30 and the cassette 14 are horizontally attached to the apparatus from the left in the direction of arrow mark A. When the cartridge side plate 310 is extended downward as shown in FIG. 20, the transfer sheet passage 15 can be formed.

In the examples shown in FIGS. 13 to 20, the multistage transfer sheet accommodation cassettes are used. However, the present invention is not limited to the specific examples. Further, in the examples shown here, the non-contact developing system is applied to the image forming apparatus. The present invention is not limited to these specific examples.

According to the present invention, transfer sheets conveyed out from the lower transfer sheet accommodation cassette, are positively conveyed to the transfer sheet passage in the apparatus when they are guided by the guide member provided the upper cassette. Therefore, it is not necessary to provide a specific guide member to the transfer sheet conveyance section of the apparatus. As a result, the present invention can provide an image forming apparatus of simple structure in which a plurality of transfer sheet accommodation cassettes can be concurrently provided. Further, the cartridge of the photoreceptor unit into which the functions of charging, developing, transferring and cleaning are incorporated, and the transfer sheet accommodation cassette can be attached to and detached from the apparatus body by an operator which is manned in the front of the image forming apparatus. Furthermore, the sorter can be provided in the upper portion of the front, so that the operator can operate it from the same position. The space to install the apparatus is small, and it is easy to maintain the apparatus of the invention and the structure is simple.

What is claimed is:

1. A sorter for sorting recording sheets in the order of copying thereof, for use with an image forming apparatus, said sorter comprising:

(a) a plurality of bins, both sides of each bin being capable of receiving recording sheets; and (b) an element means for selecting either side of said bins to receive said recording sheets discharged to said bins with image sides either face upward or face downward.

2. An image forming apparatus comprising:

(a) a main body having a first port and a second port which is disposed on the same side as said first port, open end sides of said first and said second ports being a front and operational side of said apparatus;

(b) a cassette in which recording sheets are stored, said cassette being removably insertable to said first port;

(c) a cartridge in which a photoreceptor is accommodated, said cartridge being removably insertable to said second port; and (d) a sorter for sorting recording sheets which have been fixed, said sorter being provided above said main body and adjacent on the same side as the open end sides of said first and said second ports.

3. The apparatus of claim 2 wherein said sorter sorts the recording sheets with the images thereon face downward.

4. An image forming apparatus comprising:

(a) a main body having an upper part;

(b) an image former provided in said main body for forming images onto recording sheets;

(c) a cassette provided below said image forming means for storing recording sheets and for conveying the sheets one by one toward said image forming means; and (d) a sorter having a plurality of bins for sorting said sheets having images delivered from said main body, said sorter located on said upper part, and adapted to receive said sheets as they are discharged from said main body, said plurality of bins being disposed so that trailing edges of the discharged sheets in each of said bins lie substantially in a single horizontal plane.

5. The apparatus of claim 4 wherein said sorter is capable of shifting with respect to said main body by a predetermined length in a direction perpendicular to discharging direction of the recording sheet and in a horizontal direction.

6. A sheet discharging device for use in an image forming apparatus comprising:

(a) a discharger for selectively discharging a sheet having thereon a toner image which has been fixed by fixing means, either face downward or face upward;

(b) a rotatable exit tray member having two faces, one of said faces being a first exit tray for receiving discharged sheets with said toner image face downward and the other of said faces provided on the opposite side of said one face and constituting a second exit tray for receiving discharged sheets with said toner image face upward; and (c) a rotating element rotating said rotatable exit tray member to selectively discharge sheets onto either said first exit tray or said second exit tray.

7. The device of claim 6 wherein selection of said discharging means is conducted in accordance with rotation of said rotating means.

* * * * *